US007210473B2

(12) United States Patent
Jong

(10) Patent No.: US 7,210,473 B2
(45) Date of Patent: May 1, 2007

(54) PAINTBALL MARKER AND KIT OF PARTS THEREFOR

(76) Inventor: Paul Garfield Jong, 1661 Denison Street, Markham, Ontario (CA) L3R 0N5

( * ) Notice: Subject to any disclaimer, the term of this patent is extended or adjusted under 35 U.S.C. 154(b) by 111 days.

(21) Appl. No.: 10/811,871

(22) Filed: Mar. 30, 2004

(65) Prior Publication Data

US 2004/0216728 A1 Nov. 4, 2004

Related U.S. Application Data

(63) Continuation-in-part of application No. 10/361,766, filed on Feb. 11, 2003, now Pat. No. 6,857,423.

(51) Int. Cl.
*F41B 11/32* (2006.01)

(52) U.S. Cl. ..... 124/73

(58) Field of Classification Search ..... 124/71–77, 124/56

See application file for complete search history.

(56) References Cited

U.S. PATENT DOCUMENTS

| | | | | |
|---|---|---|---|---|
| 3,303,854 A | | 2/1967 | Churchill | |
| 3,559,686 A | | 2/1971 | Hoffman | |
| 3,823,736 A | | 7/1974 | Vanti | |
| 4,566,490 A | | 1/1986 | Neff | |
| 4,574,844 A | | 3/1986 | Neff et al. | |
| 4,779,643 A | * | 10/1988 | Genbauffe | 137/599.17 |
| 4,791,960 A | | 12/1988 | Ellison | |
| 4,880,033 A | | 11/1989 | Neff | |

(Continued)

FOREIGN PATENT DOCUMENTS

DE EP 0105895 * 10/1983

(Continued)

OTHER PUBLICATIONS

European Search Report.

*Primary Examiner*—Michael J. Carone
*Assistant Examiner*—James S. Bergin
(74) *Attorney, Agent, or Firm*—Herman & Millman

(57) ABSTRACT

A paintball marker is provided including a body, an inlet control device, a firing system, a first regulator and a second regulator. The body has a paintball inlet and a barrel for receiving a paintball from the paintball inlet. The inlet control device is movable between an open position wherein the inlet control device permits entry of a paintball through the paintball inlet, and a closed position for chambering a paintball. In the closed position the inlet control device prevents entry of a paintball through the paintball inlet. The firing system includes a firing valve that is moveable between a firing position wherein the valve permits firing gas at a selected pressure to flow to the barrel and a non-firing position wherein the firing valve prevents flow of firing gas to the barrel. The first regulator is fluidically connectable to the pressurized gas source and is configurable to provide gas at a first pressure. The first regulator is operatively connected to the firing valve for movement of the firing valve between the firing and non-firing positions. The second regulator is fluidically connectable to the pressurized gas source and is configurable to provide gas at a second pressure that is lower than the first pressure. The second regulator is operatively connected to the inlet control device for movement of the inlet control device towards the closed position.

21 Claims, 32 Drawing Sheets

U.S. PATENT DOCUMENTS 4,889,164 A 12/1989 Hozumi et al.
5,282,454 A 2/1994 Bell et al.
5,409,040 A * 4/1995 Tomlin ..... 137/625.66
5,535,783 A 7/1996 Asou et al.
5,613,483 A * 3/1997 Lukas et al. ..... 124/73
5,634,456 A 6/1997 Perrone
5,640,945 A 6/1997 Slonaker et al.
5,727,538 A 3/1998 Ellis
5,809,983 A 9/1998 Stoneking
5,816,232 A 10/1998 Bell
5,823,173 A 10/1998 Slonaker et al.
5,878,736 A 3/1999 Lotuaco, III
5,881,707 A 3/1999 Gardner, Jr.
5,954,042 A 9/1999 Harvey
5,967,133 A 10/1999 Gardner, Jr.
6,003,504 A 12/1999 Rice et al.
6,035,843 A 3/2000 Smith et al.
6,065,460 A 5/2000 Lotuaco, III
6,138,656 A 10/2000 Rice et al.
6,192,937 B1 * 2/2001 Fagerlie et al. ..... 137/625.63
6,213,110 B1 4/2001 Christopher et al.
6,311,682 B1 11/2001 Rice et al.
6,343,599 B1 2/2002 Perrone
6,349,711 B1 2/2002 Perry et al.
6,360,736 B1 3/2002 Juan
6,390,445 B2 5/2002 Fukano
D459,441 S 6/2002 Hayashi et al.
6,439,217 B1 8/2002 Shih
6,470,872 B1 10/2002 Tiberius et al.
6,474,326 B1 11/2002 Smith et al.
6,520,171 B2 2/2003 Reible
6,543,481 B2 4/2003 Neff et al.
6,561,176 B1 5/2003 Fujimoto et al.
6,637,420 B2 10/2003 Moritz
6,763,822 B1 7/2004 Styles
6,772,791 B2 * 8/2004 Neff ..... 137/625.65
6,802,305 B1 10/2004 Hatcher
6,889,682 B2 * 5/2005 Styles et al. ..... 124/77
6,901,923 B2 * 6/2005 Jones ..... 124/77
2001/0042543 A1 * 11/2001 Perrone ..... 124/77
2001/0170552 11/2001 Perrone
2002/0170552 A1 11/2002 Gardner, Jr.
2003/0024521 A1 2/2003 Smite et al.
2003/0047222 A1 * 3/2003 Neff et al. ..... 137/625.64
2003/0168052 A1 * 9/2003 Masse ..... 124/73
2005/0028802 A1 * 2/2005 Jones ..... 124/73
2005/0235976 A1 * 10/2005 Carnall ..... 124/73

FOREIGN PATENT DOCUMENTS

GB 902640 * 10/1960
GB 2129528 A * 11/1983
WO WO0075594 12/2000

* cited by examiner

PAINTBALL MARKER AND KIT OF PARTS THEREFOR

FIELD OF THE INVENTION

The present invention relates to paintball markers and more particularly to mechanisms for chambering and firing of paintballs in paintball markers.

BACKGROUND OF THE INVENTION

Many people today enjoy playing paintball games with sophisticated paintball markers. A typical paintball marker has a barrel from which paintballs are fired. A breech is provided which receives paintballs through an inlet, and which communicates with the barrel. A paintball tube holds paintballs for feeding into the breech. A bolt slides within the breech to chamber a paintball, ie. to move a paintball that has been fed into the breech, into the barrel. The bolt also controls the entry of paintballs from the paintball tube into the breech. The bolt is typically moved between an open position whereby a paintball is permitted to enter the breech and a closed position whereby the entry of paintballs into the breech is prevented. A pneumatic actuator, such as a pneumatic cylinder is typically used to move the bolt.

If a paintball does not feed correctly in the breech, the bolt can squash and rupture the paintball, releasing paint onto the interior mechanisms of the marker. As a result, the released paint can disrupt the proper functioning of the marker. Consequently, after a paintball is squashed inside a marker, it is usually required for the marker to be disassembled and cleaned to remove any paint on the interior mechanisms.

Another problem with current markers is the use of solenoid valves, which have been incorporated into markers to operate the firing valve and the bolt. Solenoid valves are favoured at least in part for their seemingly quick response time, however, several problems exist with markers in which solenoid valves are present. These markers by necessity include relatively complex electrical systems, which include a battery and typically a control circuit which assists in timing the sequence of operation of the solenoids. All of these electrical components are a source of unreliability in such paintball markers. For example, during play a battery could run out of power. Furthermore, during adverse conditions, such as wet, cold or hot conditions, the electrical components are at risk of failing. Typically, electrical components are not sufficiently robust to withstand repeated impacts, which can occur as a player inadvertently drops or otherwise impacts a marker during play.

There is, therefore, a continuing need for improved paintball markers that have a reduced tendency to squash and rupture paintballs during a loading and chambering operation. Also, in another aspect, there is a need for improved markers that are capable of firing quickly and at high frequency, but that have a reduced dependence on electrical components, such as solenoids.

SUMMARY OF THE INVENTION

In a first aspect, the invention is directed to a paintball marker including a body, an inlet control device, a firing system, a first regulator and a second regulator. The body has a paintball inlet and a barrel for receiving a paintball from the paintball inlet. The inlet control device is movable between an open position wherein the inlet control device permits entry of a paintball through the paintball inlet, and a closed position for chambering a paintball. In the closed position the inlet control device prevents entry of a paintball through the paintball inlet. The firing system includes a firing valve that is moveable between a firing position wherein the valve permits firing gas at a selected pressure to flow to the barrel and a non-firing position wherein the firing valve prevents flow of firing gas to the barrel. The first regulator is fluidically connectable to the pressurized gas source and is configurable to provide gas at a first pressure. The first regulator is operatively connected to the firing valve for movement of the firing valve between the firing and non-firing positions. The second regulator is fluidically connectable to the pressurized gas source and is configurable to provide gas at a second pressure that is lower than the first pressure. The second regulator is operatively connected to the inlet control device for movement of the inlet control device towards the closed position. The inlet control device may be, for example, a bolt.

In a second aspect, the invention is directed to a paintball marker having a trigger and a flow control valve. The trigger is operatively connected to the flow control valve. The flow control valve includes a housing defining an interior. The housing has a first, a second, a third, a fourth and a fifth port, wherein the ports are longitudinally spaced apart. The housing further includes a first, a second, a third and a fourth housing projections extending into the interior longitudinally between the first and second ports, the second and third ports, the third and fourth ports and the fourth and fifth ports respectively. The housing projections have a first, a second, a third and a fourth housing sealing surface thereon respectively. The flow control valve further includes an elongate valve spool that is slidably mounted in the housing. The valve spool has a first, a second, a third and a fourth generally ring-shaped spool projection. The spool projections are longitudinally spaced apart. The spool projections have a first, a second, a third and a fourth spool sealing surface thereon respectively for sealing engagement with the housing sealing surfaces. The valve spool is moveable between a first position wherein the second and fourth spool sealing surfaces seal against the second and fourth housing sealing surfaces respectively to permit fluid communication between the third port and the fourth port and between the first port and the second port, and a second position wherein the first and third spool sealing surfaces seal against the first and third housing sealing surfaces respectively to permit fluid communication between the second port and the third port and between the fourth port and the fifth port. The valve spool is engageable by the trigger by at least one of a mechanical and a pneumatic connection for movement to at least one of the first and second positions, without the use of a solenoid to actuate the valve. For example, the valve spool may be engageable directly by the trigger. Furthermore, actuation of the valve spool mechanically or pneumatically by the trigger removes steps that occur in a solenoid actuated valve, namely the steps of contacting the trigger with the sensor and actuating the solenoid. Because of the configuration of the valve sealing surfaces, and because the valve spool is actuated by the trigger mechanically or pneumatically instead of through an intermediate solenoid, the overall response time of the valve is fast, and the marker does not suffer any of the problems associated with electrical components, such as their relatively poor reliability, particularly in wet, cold or hot conditions.

In a third aspect, the invention is directed to a gas storage chamber and an adjustment member. The gas storage chamber is configured for storing gas for use in firing a paintball. The adjustment member is moveably connected to the gas storage chamber for movement within a range of adjustment. The adjustment member occupies a selectable portion of the volume contained within the gas storage chamber. This permits the player to optimize the use of the air in the air tank for the marker. For example, the player can incrementally adjust down the volume of the chamber until the velocity of a fired paintball is observed to drop off. In this way, the player can obtain an increased number of shots per tank. Also, the player can adjust the chamber volume in general, in response to playing conditions.

In a fourth aspect the invention is directed to a method for controlling pneumatic operations of a paintball marker, the paintball marker having a body having a paintball inlet and an inlet control device, wherein the inlet control device is moveable between an open position and closed position for controlling the flow of paintballs through the paintball inlet and for chambering a paintball, wherein the inlet control device is movable by means of an inlet control device actuator, wherein the inlet control device actuator is pneumatically operated, the paintball marker further including a firing valve, wherein the firing valve is moveable between an open position and a closed position and is movable to at least one of the open and closed positions by a firing valve actuator, wherein the firing valve actuator is pneumatically operated, the method comprising:

providing gas at a first pressure to the inlet control device actuator to move the inlet control device to an open position to permit entry of a paintball through the paintball inlet;

providing gas at a second pressure the pneumatic cylinder to move the inlet control device to a closed position to prevent entry of a paintball through the paintball inlet and to chamber a paintball, wherein the second pressure is selected to be sufficiently low to inhibit rupturing of a paintball if, during use, the paintball is confined by the inlet control device during movement of the inlet control device towards the closed position; and providing gas at a third pressure to the firing valve actuator for movement of the firing valve to at least one of the open and closed positions, wherein the third pressure is higher than the second pressure.

In a fifth aspect the invention is directed to a paint ball marker having a trigger and a flow control valve. The trigger is operatively connected to the flow control valve. The flow control valve includes a housing defining an interior. The housing has a plurality of longitudinally spaced projections extending into the interior. The projections have housings sealing surfaces thereon. The flow control valve further includes an elongate valve spool that is slideably mounted in the housing. The valve spool has a plurality of longitudinally spaced generally ring shaped spool projections. The spool projections have spool sealing surfaces thereon for sealing engagement with the housing sealing surfaces. The valve spool is moveable between a first position and a second position to control the flow of pressurized gas through the valve in one direction and the exhaustion of the gas through the valve in another direction. The valve spool is engageable by the trigger by one of a mechanical and a pneumatic connection for movement to at least one of the first and second positions, without the use of a solenoid to actuate the valve. Furthermore, actuation of the valve spool mechanically or pneumatically by the trigger removes steps that occur in a solenoid actuated valve, namely the steps of contacting the trigger with the sensor and actuating the solenoid. Because of the configuration of the valve sealing surfaces, and because the valve spool is actuated by the trigger mechanically or pneumatically instead of through an intermediate solenoid, the overall response time of the valve is fast, and the marker does not suffer any of the problems associated with electrical components, such as their relatively poor reliability, particularly in wet, cold or hot conditions.

BRIEF DESCRIPTION OF THE DRAWINGS

The present invention will now be described by way of example only with reference to the attached drawings, in which.

DETAILED DESCRIPTION OF THE INVENTION

Figure 1A:
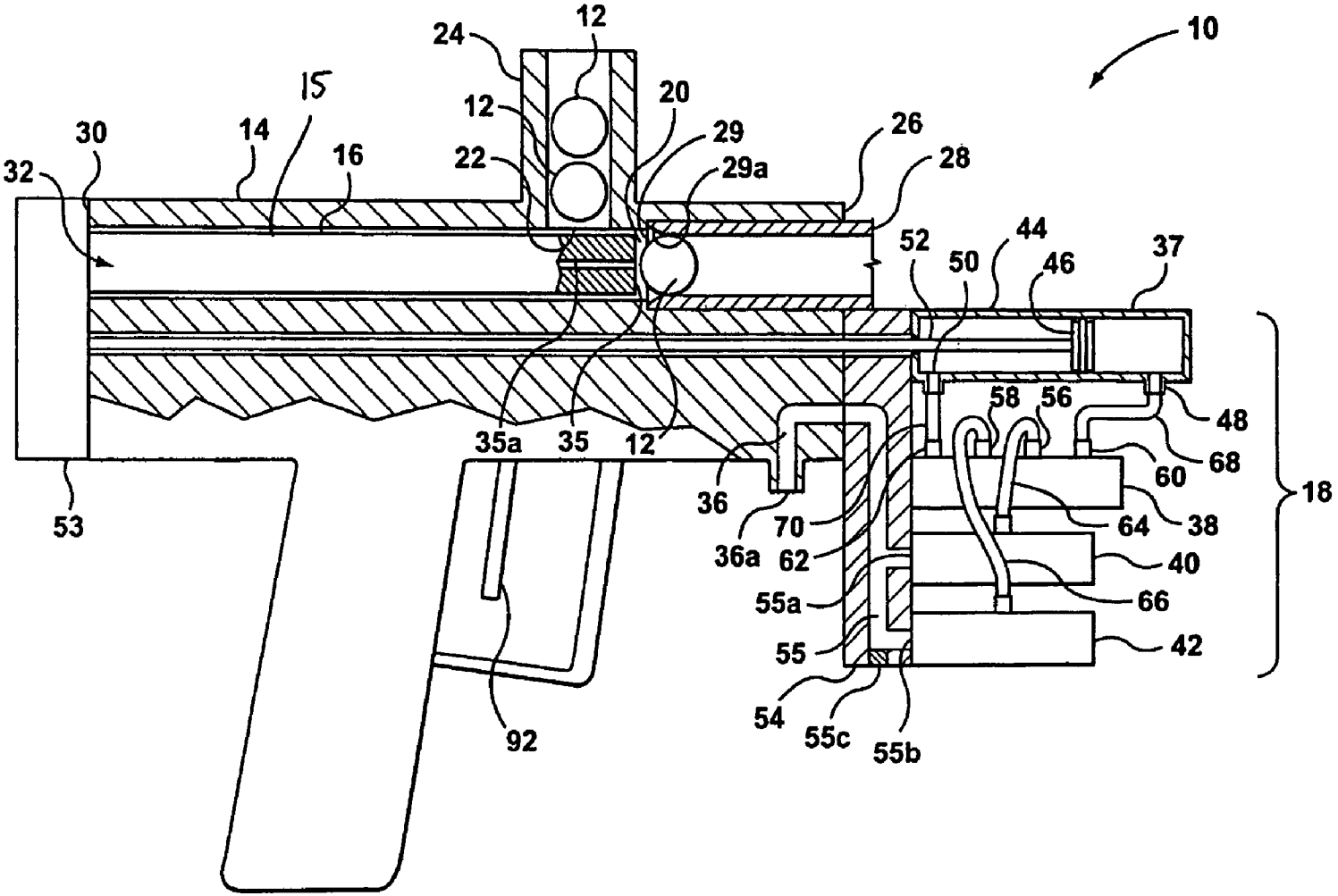
FIG. 1*a* is a partially sectional side view of a paintball marker in accordance with a first embodiment of the present invention, in a bolt-closed position.

Reference is made to FIG. 1*a*, which shows a paintball marker 10 in accordance with a first embodiment of the present invention. The paintball marker 10 is used to fire paintballs 12 during, for example, a paintball game. For simplicity and greater clarity of the Figures, several of the components of the paintball marker 10 that are involved in the firing of paintballs 12 have not been shown in the Figures.

The paintball marker 10 includes a body 14, an inlet control device 15, which may be, for example, a bolt 16, and an actuation system 18. The body 14 defines a chamber 20, that is typically called a breech, for holding a paintball 12 to be fired. The breech 20 has a paintball inlet 22 through which paintballs 12 are fed one at a time for firing. A paintball tube 24 may extend outwards from the body 14 for holding a plurality of paintballs 12 to be fed into the breech 20. The breech 20 may extend generally linearly and may have a front end 26, which is open. The breech 20 has a diameter that is sufficiently large that it does not hamper the movement of the paintball 12 therein.

A barrel 28 may be mounted in the front end 26 in fluid communication with the breech 20. The barrel 28 may have a diameter that is the same or optionally slightly smaller than the diameter of the paintballs 12. It will be appreciated that the diameter of the barrel 28 is also smaller than the diameter of the breech 20.

The barrel 28 has an inlet which is shown at 29. The inlet 29 includes a transition portion 29*a* (shown more clearly in FIG. 1*b*), which smoothly transitions from the diameter of the breech 20 to the diameter of the barrel 28.

Figure 1B:
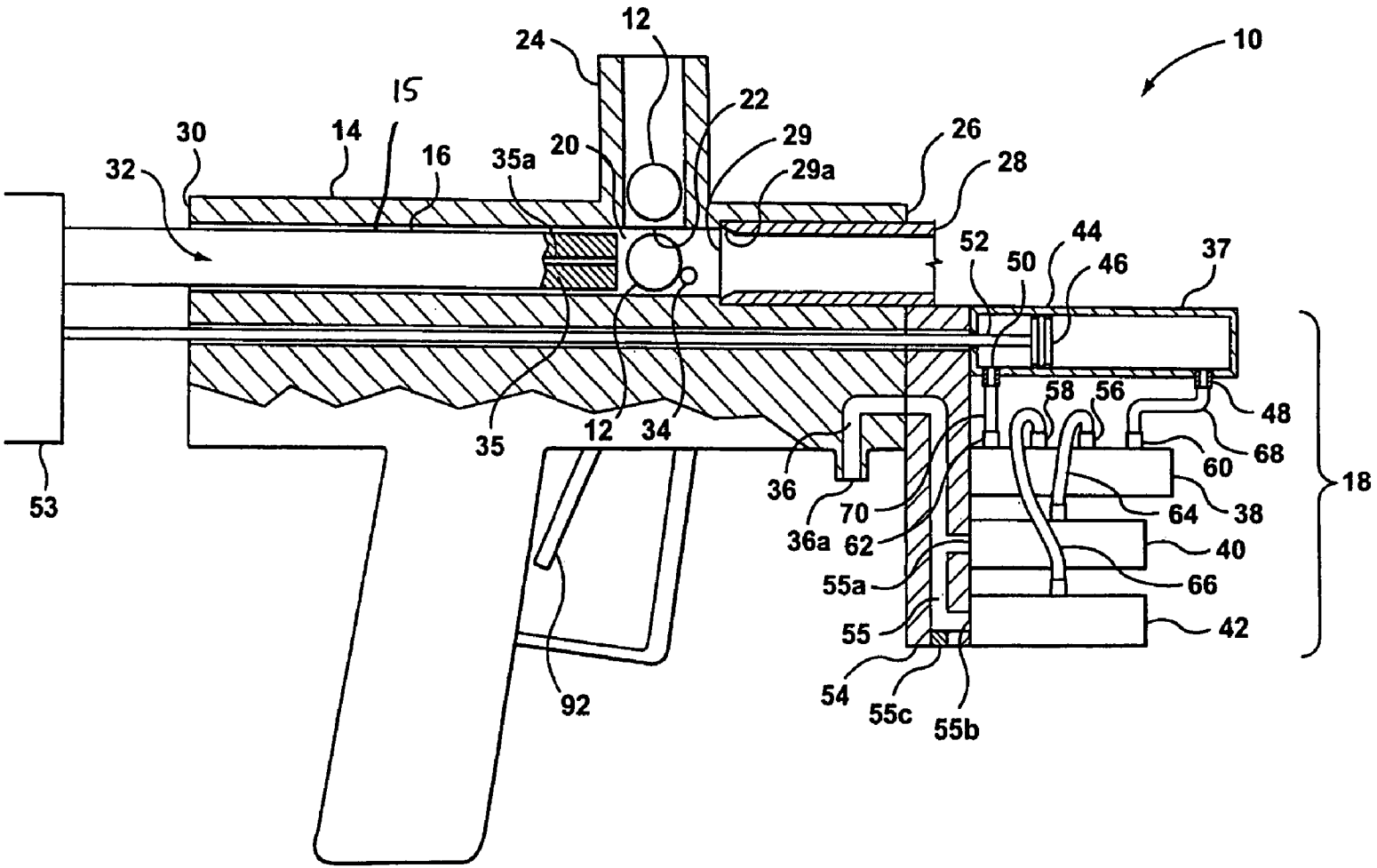
FIG. 1*b* is a partially sectional side view of the paintball marker shown in FIG. 1*a*, in a bolt-open position.

The breech 20 has a rear end 30 in which there is an opening 32. The bolt 16 is slideable within the breech 20 and connects to the actuation system 18 through the opening 32. The bolt 16 is moveable by means of the actuation system 18, between a closed position, as shown in FIG. 1*a* and an open position, as shown in FIG. 1*b*. When the bolt 16 is in the closed position, a paintball 12 is held in position between the forward end of the bolt 16, which is shown at 35, and the inlet 29 of the barrel 28. Because of the snug fit of the paintball 12 in the barrel 28, the paintball 12 is prevented from rolling out of the barrel 28 prior to firing of the paintball marker 10. In the embodiment shown in FIG. 1*a*, the paintball 12 is positioned only partially in the barrel 28 when the bolt 16 is in the closed position. It is alternatively possible, however, to have an embodiment (not shown), wherein the bolt 16 pushes the paintball 12 further into the barrel 28 prior to firing of the marker 10.

When the bolt 16 chambers a paintball 12, the bolt 16 also blocks the paintball inlet 22, and prevents other paintballs 12 from entering the breech 20, when in the closed position shown in FIG. 1*a*. An outlet 35*a* is provided in the forward end 35 of the bolt 16, for pressurized air. When the paintball marker 10 is fired, pressurized air exits through the outlet 35*a* to fire the paintball 12 through the barrel 28 and out of the marker 10.

Reference is made to FIG. 1*b*, which shows the paintball marker 10 in the bolt-open position. When the bolt 16 is in the open position, the bolt 16 does not block the paintball inlet 22, and thus permits the entry of a paintball 12 into the breech 20. As shown in FIG. 1*b*, when in the open position, the bolt 16 may extend outwards from the breech 20 through the opening 32.

When in the open position, the front end 35 of the bolt 16 may be positioned generally aligned with the rearmost edge of the paintball inlet 22. A detent 34 extends into the breech 20 proximate the forwardmost edge of the paintball inlet 22. When the bolt 16 is open, the detent 34 and the bolt 16 cooperate to retain a paintball 12 in the breech 20. The paintball 12 in the breech 20 is positioned in such a way as to block other paintballs 12 from entering the breech 20.

The detent 34 is resilient so as to permit the bolt 16 to push a paintball 12 therepast during closure of the bolt 16. The detent 34 may be resilient by any suitable means, such as by being spring loaded.

The detent 34 is shaped so as not to rupture the paintball 12 as it moves therepast. For example the detent 34 may be spherical.

The actuation system 18 is used to move the bolt 16 between the open and closed positions. The actuation system 18 may be any suitable type of actuation system. For example, the actuation system 18 may utilize gas pressure from a suitable gas source such as a pressurized air tank 400 (see FIG. 1*i*), to drive the bolt 16 between the open and closed positions. The pressurized air tank 400 (FIG. 1*i*) may contain an actuation gas, such as air, at several thousand psi, at least initially. A primary regulator (not shown) may be connected to the air tank to reduce the air pressure down to a pressure suitable for firing a paintball 12, eg. approximately 150 psi to approximately 350 psi. The primary regulator (not shown) may be a single stage regulator, or alternatively may be a dual stage regulator, essentially consisting of two regulators in series to reduce the air pressure in stages down to the firing pressure. The marker 10 includes an air conduit 36 for transporting air from the primary regulator (not shown) through an inlet 36*a*, to the firing mechanism (not shown in this Figure) and to the actuation system 18.

The actuation system 18 includes an actuator 37, which may be a pneumatic cylinder 37, a control valve 38, a first low pressure regulator 40, and a second low pressure regulator 42. The pneumatic cylinder 37 includes a housing 44 and a piston 46. Movement of the piston 46 within the housing 44 is controlled by the entry and discharge of air in the housing 44 through a first port 48 and a second port 50. A rod 52 extends from the piston 46 out from the pneumatic cylinder 37 and through the body 14 of the paintball marker 10. The rod 52 connects the piston 46 to a back plate 53, to which the bolt 16 is also connected. By virtue of the connection of the piston 46 to the bolt 16 by means of the rod 52 and the back plate 53, movement of the piston 46 in the housing 44 causes movement of the bolt 16 in the breech 20.

The first and second low pressure regulators 40 and 42 are mounted in fluid communication with the air conduit 36 to receive air from the primary regulator (not shown). More specifically, the paintball marker 10 may include a manifold 54 that has an internal air conduit 55 therein that is in fluid communication with the air conduit 36.

The manifold 54 has a first port 55*a* for connection to the first low pressure regulator 40 and a second port 55*b* for connection to the second low pressure regulator 42. The manifold 54 may optionally also include a third port 55*c*, which may be used as desired, or which may be plugged when not in use.

The manifold 54 may be a separate component that mounts to the body 16 of the paintball marker 10, or alternatively, the manifold 54 may be integral with the body 16. The manifold 54 may include mounting means for the first and second low pressure regulators 40 and 42, for the control valve 38 and for the pneumatic cylinder 37, as shown in FIG. 1*a*. It is alternatively possible, however, for some or all of these components to mount to the body 16 instead of mounting onto the manifold 54.

Pressurized air travels from the air tank 400 (FIG. 1*i*) through the primary regulator (not shown), where it is reduced to the firing pressure. From there the air travels through the air conduit 36 in the body 16, and from the air conduit 36, through the internal air conduit 55 in the manifold 54. From the air conduit 55, the air is distributed to the first and second low pressure regulators 40 and 42.

It is alternatively possible, however, for the primary regulator (not shown) to be connected directly into the manifold 54 using the optional port 55*c*, instead of being connected to the air conduit inlet 36*a* on the body 16. In that case, it will be appreciated that the inlet 36*a* on the body 16 would require plugging.

The low pressure regulators 40 and 42 reduce the pressure of the air received from the primary regulator (not shown), down to two different outlet pressures. The first low pressure regulator 40 may reduce the pressure of the air to between approximately 50 psi and approximately 100 psi, and the second low pressure regulator 42 may reduce the pressure of the air to between approximately 5 psi and approximately 50 psi. The air pressures provided by the low pressure regulators 40 and 42 may be selected based on the specific characteristics of the components of the paintball marker 10. For example, if there is significant resistance in the movement of the bolt 16 in the breech 20, the regulators 40 and 42 may be selected to provide air at higher pressures. Conversely, if for example, the bolt 16 moves with little resistance in the breech 20 then accordingly, lower pressure may be selected for the second regulator 42 and for the first regulator 40 if it is involved in movement of the bolt 16 towards its open position.

The control valve 38 controls the movement of the piston 46 by controlling the flow of air from the regulators 40 and 42 to the first and second ports 48 and 50. The control valve 38 includes a first inlet port 56, a second inlet port 58, a first outlet port 60 and a second outlet port 62. The first inlet port 56 is connected to the outlet of the regulator 40 by means of a first conduit 64. The first outlet port 60 is connected to the first port 48 of the pneumatic cylinder 37 by means of a second conduit 68. The second inlet port 58 is connected to the outlet of the regulator 42 by means of a third conduit 66. The second outlet port 62 is connected to the second port 50 of the pneumatic cylinder 37 by means of a fourth conduit 70. The conduits 64, 66, 68 and 70 may be flexible conduits, such as, for example, flexible plastic tubing. Alternatively, they may be rigid or semi-rigid conduits, such as, for example, stainless steel tubing.

When it is desired to move the bolt 16 from the closed position shown in FIG. 1*a* to the open position shown in FIG. 1*b*, the control valve 38 directs air from the first regulator 40 to the first port 48 on the pneumatic cylinder 37. The increase in pressure in the housing 44 in front of the piston 46 drives the piston 46 rearwardly. Because the bolt 16 is connected to the piston 46 by means of the back plate 53 and the rod 52, the bolt 16 is also moved rearwardly as a result of the movement of the piston 46.

When it is desired to move the bolt 16 from the open position shown in FIG. 1*b* to the closed position shown in 1*a*, the control valve 38 directs air from the regulator 42 to the second port 50 on the pneumatic cylinder 37. The increase in air pressure in the housing 44 behind the piston 46 drives the piston 46, and in turn, the bolt 16 forward to the closed position.

Figure 2:
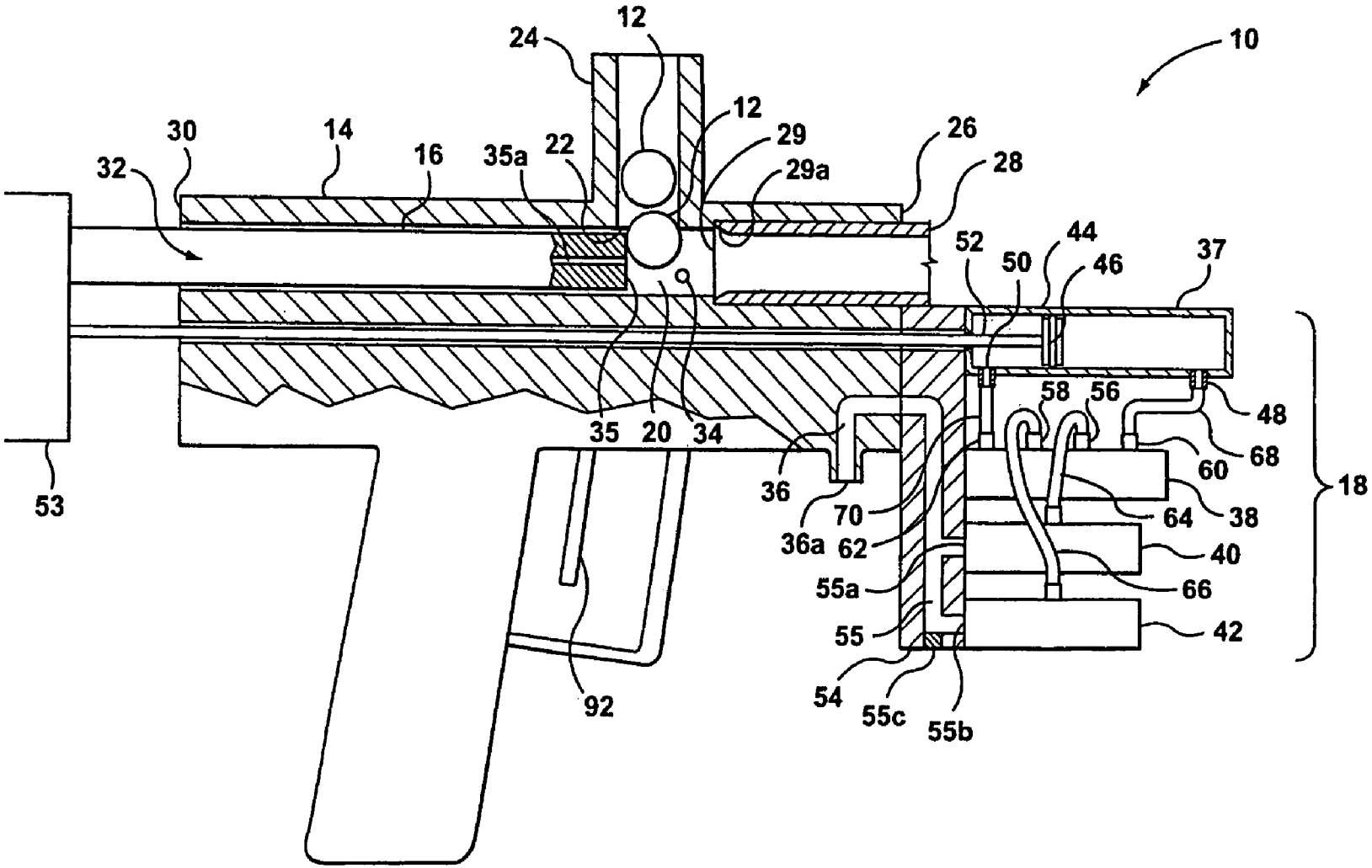
FIG. 2 is a partially sectional side view of the paintball marker shown in FIG. 1*a*, illustrating a mis-feed of a paintball.

Reference is made to FIG. 2. When the bolt 16 is in the open position to permit the entry of a paintball 12 into the breech 20, it is possible for a variety of reasons for the paintball 12 not to have fully entered the breech 20 when the bolt moves towards the closed position. In such an instance, the bolt 16 can jam against the mis-fed paintball, pinning the paintball 12 in the paintball inlet 22. Because of the relatively low air pressure and corresponding relatively low force used to drive the piston 46 and the bolt 16 forward, the bolt 16 has a reduced likelihood of rupturing the mis-fed paintball 12 upon jamming there against.

Figure 3A:
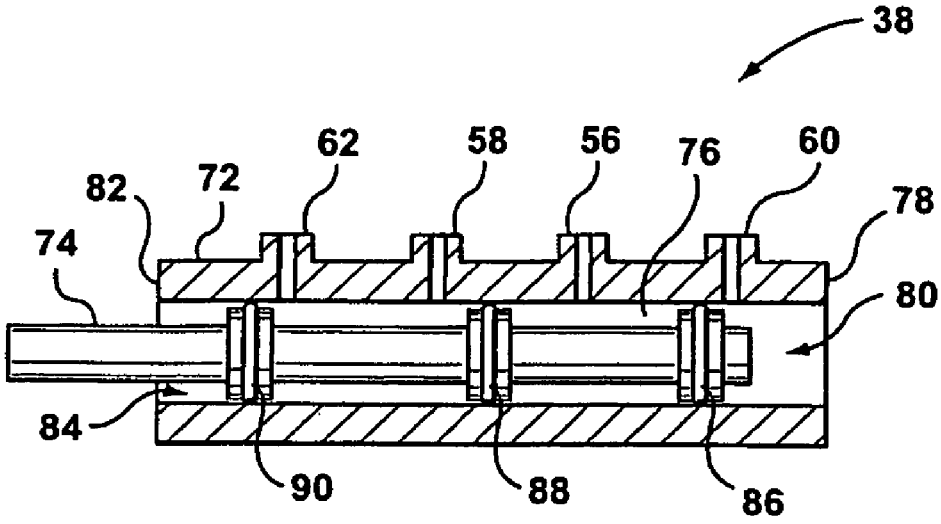
FIGS. 3*a* and 3*b* are magnified sectional side views illustrating the operation of a control valve for the paintball marker shown in FIG. 1*a;*
Figure 3B:
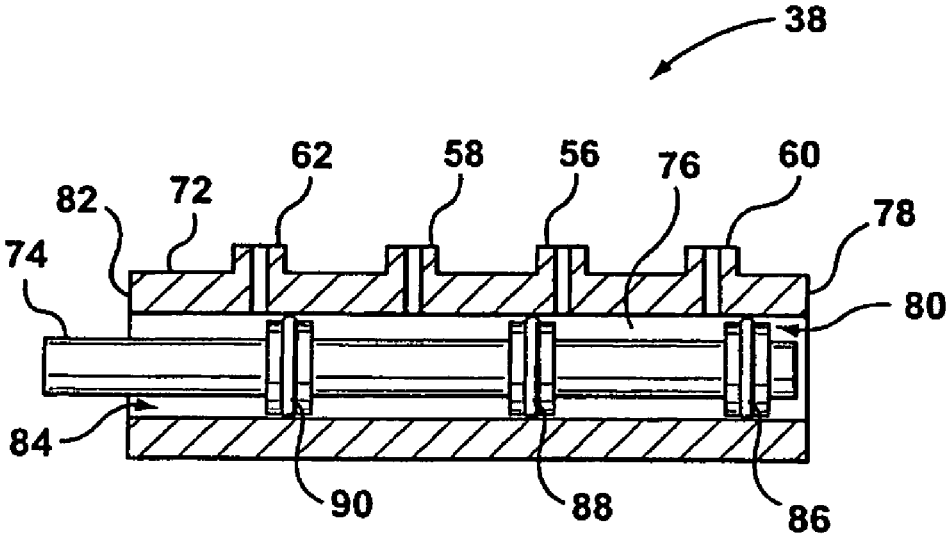

Reference is made to FIGS. 3*a* and 3*b* which show the control valve 38 in more detail, and which illustrate its operation. The control valve 38 includes a housing 72 and a valving element 74. The inlet ports 56 and 58 and the outlet ports 60 and 62 may be positioned in a linear arrangement on the housing 72, and may be in the order shown in the Figures, whereby the first and second inlet ports 56 and 58 are positioned inside the first and second outlet ports 60 and 62. The housing 72 defines an internal passage 76 with which all of the ports 56, 58, 60 and 62 communicate. The housing 72 has a first end 78. The internal passage 76 has a first vent 80 in the first end 78. The housing 72 has a second end 82 in which there is positioned a second vent 84 for the internal passage 76.

The valving element 74 is moveable within the internal passage 76 to direct the flow of air into and out of the control valve 38. The valving element 74 includes a first seal 86, a second seal 88, and a third seal 90. When the control valve 38 is in a first control valve position, as shown in FIG. 3*a*, the first seal 86 is positioned between the first inlet port 56 and the first outlet port 60, thereby preventing them from communicating with each other. Furthermore, the first outlet port 60 is in fluid communication with the first vent 80. Because the first outlet port 60 is also in fluid communication with the portion of the pneumatic cylinder housing 44 in front of the piston 46, this portion of the housing 44 is at substantially atmospheric pressure.

In the first control valve position shown in FIG. 3*a*, the second and third seals 88 and 90 are positioned to form a chamber with which the second inlet port 58 and the second outlet port 62 communicate. Thus, in this position, air from the outlet of the second regulator 42 is transmitted to the portion of the pneumatic cylinder housing 44 behind the piston 46. This, in turn, causes the piston 46 to move to its forwardmost position, as shown in FIG. 1*a*. This, in turn, causes the bolt 16 to move to the closed position, as shown in FIG. 1*a*.

Reference is made to FIG. 3*b*, which shows the control valve 38 in a second control valve position. In the second control valve position, the valving element 74 is moved so that the third seal 90 is positioned between the second inlet port 58 and the second outlet port 62, thus preventing them from communicating with each other. Furthermore, in the position shown in FIG. 3*b*, the second outlet port 62 is in fluid communication with the second vent 84, which in turn causes the portion of the pneumatic cylinder housing 44 behind the piston 46 to be at substantially atmospheric pressure.

Furthermore, the first and second seals 86 and 88 cooperate to define a chamber around the first inlet port 56 and the first outlet port 60, permitting them to be in fluid communication with each other. Thus, in the position shown in FIG. 3*b* air from the outlet of the first regulator 40 is transmitted to the portion of the pneumatic cylinder housing 44 in front of the piston 46, which drives the piston 46 to its rearwardmost position, as shown in FIG. 1*b*.

Referring to FIG. 1*a*, when it is desired to fire the paintball marker 10, a trigger 92 that is positioned on the body 14, is pulled. Pulling of the trigger 92 causes pressurized air to be released through the outlet 35*a* in the bolt 16, to fire the chambered paintball 12 from the barrel 28. The linkage between the trigger 92 and the firing mechanism may be mechanical, pneumatic, hydraulic, electrical, electronic or any combination thereof.

The trigger 92 is operatively connected to the actuation system 18, and more specifically to the valving element 74 (FIGS. 3*a* and 3*b*). The connection may be by any suitable means, such as, for example, a mechanical linkage (not shown), a pneumatic connection (not shown), an electrical connection (not shown), an electronic connection (not shown), or any combination thereof. Pulling of the trigger 92 causes firing of the chambered paintball 12 as described above, and then causes movement of the valving element 74 between the first control valve position (see FIG. 3*a*) and the second control valve position (see FIG. 3*b*). The valving element 74 may extend out of the housing 72 (see FIGS. 3*a* and 3*b*) for operatively connecting to the trigger 92.

The paintball marker 10 shown in the embodiment in FIGS. 1*a* and 1*b* is a "closed bolt" configuration, because the bolt 16 remains in the closed position (shown in FIG. 1*a*) when the trigger 92 is at rest. It is alternatively possible, however, for a paintball marker within the scope of this invention to have an open bolt configuration, whereby the bolt remains in the open position when the trigger is at rest. In that case, when the trigger is pulled, the bolt closes with a closing force that is sufficiently low so as to inhibit rupturing of the paintball. Once in the closed position, the paintball that has been chambered is held between the bolt and the barrel. At this point, pressurized air is released to fire the paintball 12 from the barrel 28.

Reference is made to FIGS. 1*c*, 1*d*, 1*e*, 1*f*, 1*g* and 1*h*, which illustrate alternative firing mechanisms 300 that may be used with the marker 10. The firing mechanism 300 in general controls the release of a volume of high-pressure air into the bolt 16 for firing the paintball 12.

Figure 1C:
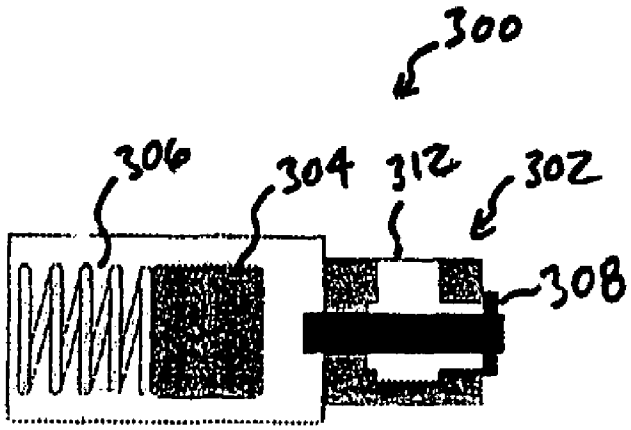
FIGS. 1*c* and 1*d* are side views that illustrate the operation of a firing mechanism that may be used with the marker shown in FIG. 1*a;*
Figure 1D:
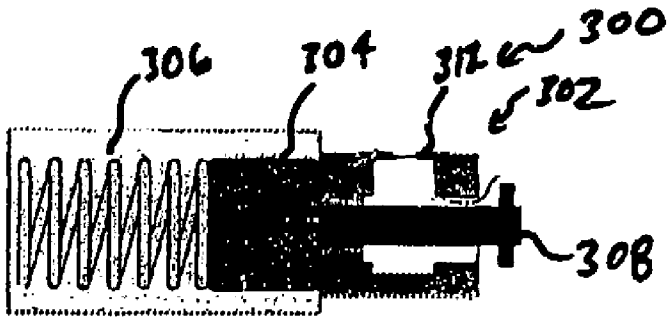

Referring to FIGS. 1*c* and 1*d*, the firing mechanism 300 may comprise a firing valve 302 and an actuator 303, which may include a striker 304 and a spring 306 connected between a fixed element of the marker 10 and the striker 302. The striker 304 is held in a rest position wherein the spring 306 is compressed (see FIG. 1*c*), by a holding means, such as a sear (not shown). The trigger 92 (FIG. 1*a*) may be operatively connected to the holding means (not shown). When the trigger 92 is pulled, the holding means, eg. the sear, releases the striker 304, at which point the spring 306 drives the striker 304 into a valving element 308 in the firing valve 302. The valving element 308 is engaged by the striker 304 and is moved into an open position (see FIG. 1*d*) to permit a volume of air to pass through the valve 302, as shown by the arrow A, out the valve outlet, shown at 312, and indirectly or directly into the bolt 16 (see FIG. 1*a*), for firing the paintball 12.

After releasing air through the valve 302, the valving element 312 moves from the open position to the closed position (see FIG. 1*c*). The valving element 312 may be driven towards the closed position by any suitable means, such as, for example, by means of air pressure from the firing air acting on the valving element 312 or by a spring (not shown).

Any suitable means, eg. pneumatic pressure from the first low pressure regulator 40 (FIG. 1*a*), may be used to drive the striker 304 back to re-compress the spring 306 and re-engage the sear (not shown).

Movement of the sear (not shown) may be accomplished by any means known in the art. For example, the sear may be actuated by a mechanical linkage connected to the trigger 92. Alternatively, movement of the sear may be controlled by an electric solenoid or by an electronic solenoid valve.

Figure 1E:
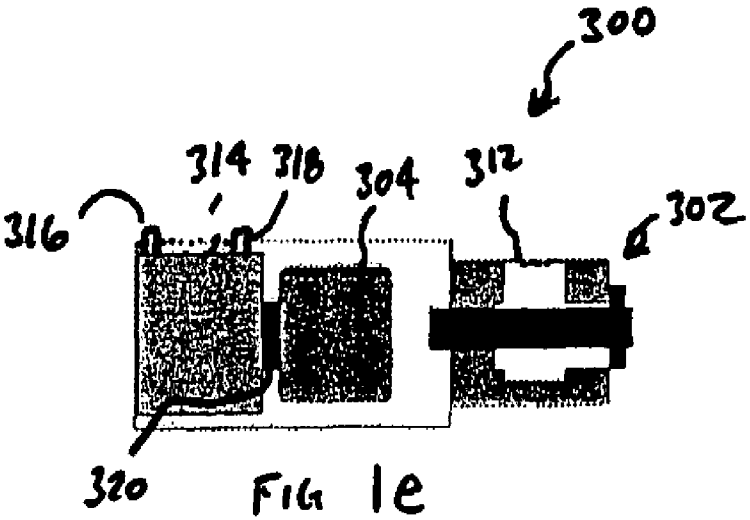
FIGS. 1*e* and 1*f* are side views that illustrate the operation of an alternative firing mechanism that may be used with the marker shown in FIG. 1*a;*
Figure 1F:
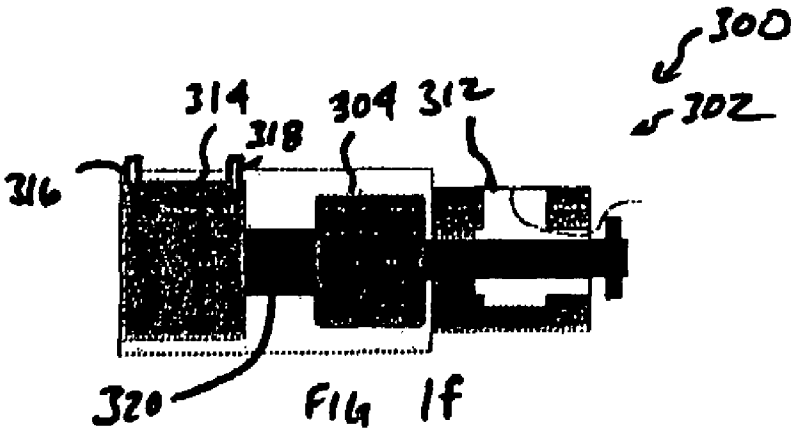

Reference is made to FIGS. 1*e* and 1*f*, which show an alternative firing mechanism 300. In this alternative, the actuator 303 may include the striker 304 and a pneumatic cylinder 314 instead of a spring and sear. The pneumatic cylinder 314 includes a first port 316 and a second port 318, which may both be configured to selectively receive air from the first regulator 40. The trigger 92 (FIG. 1*a*) is operatively connected to the pneumatic cylinder 314 to control air from the first regulator 40 through each of the ports 316 and 318. Air flow to the first and second ports 316 and 318 controls the movement of a piston (not shown) inside the cylinder 314. A piston rod 320 is connected at one end, to the piston (not shown). The striker 304 is connected to the other end of the piston rod 320.

When the trigger 92 (FIG. 1*a*) is pulled, air from the first regulator 40 is released into the first port, and drive the piston (not shown), the piston rod 320 and striker 304 into engagement with the valving element 312, pushing the valving element 312 open to permit a volume of high pressure air through the valve 306 and into the bolt 16 (see FIG. 1*a*) for firing.

The firing valve 302 may be configured to close by the same means used in the embodiment shown in FIGS. 1*c* and 1*d*, eg, by means of the high pressure firing air. The trigger 92 (FIG. 1*a*) may be operatively connected to the pneumatic cylinder to control air flow thereto from the first regulator 40, by any suitable means.

Figure 1H:
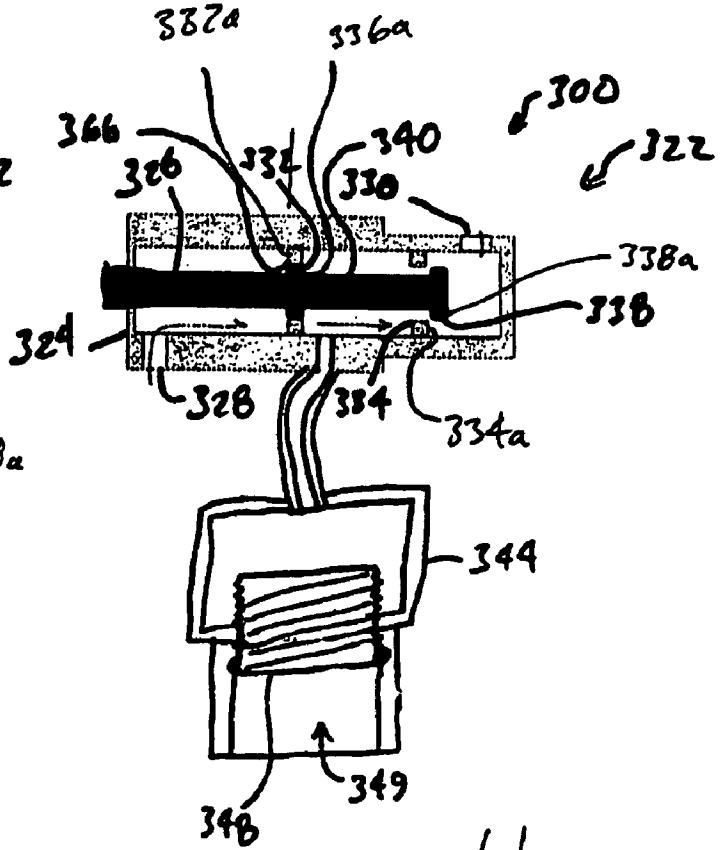
FIGS. 1*g* and 1*h* are side views that illustrate the operation of another alternative firing mechanism that may be used with the marker shown in FIG. 1*a*.
Figure 1G:
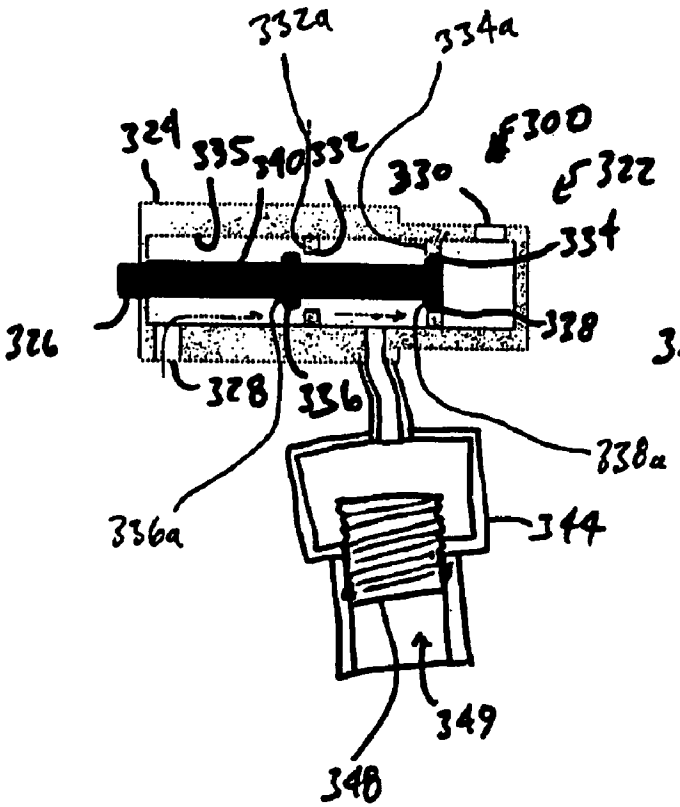
Figure 1I:
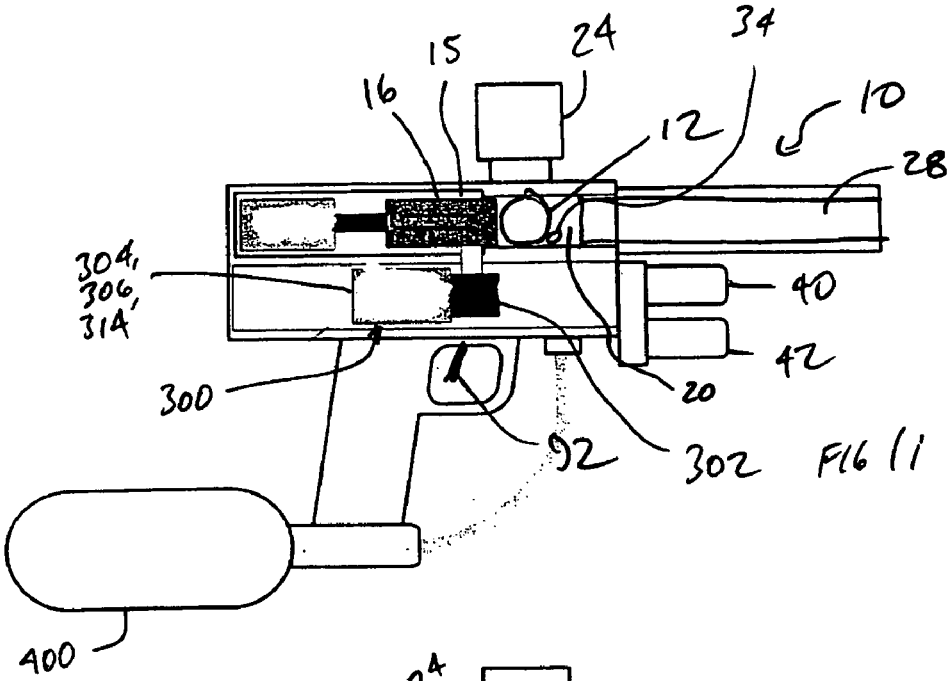
FIGS. 1*i* and 1*j* are side views of a marker using any of the three firing mechanisms shown in FIGS. 1*c* and 1*d*, 1*e* and 1*f* and 1*g* and 1*h*, in a two-tube configuration.
Figure 1J:
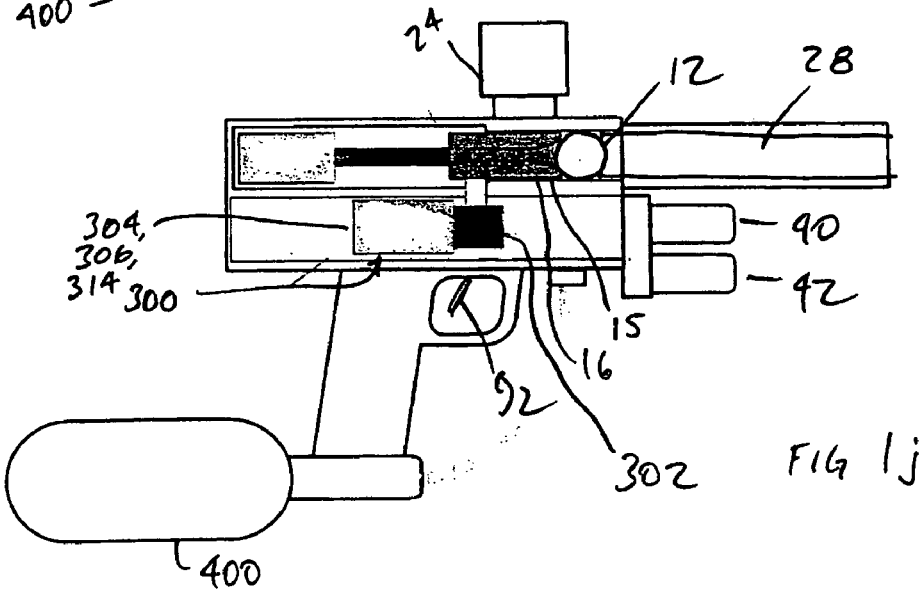

Reference is made to FIGS. 1*i* and 1*j*, which illustrate the operation of the marker 10, configured as a two-tube marker, incorporating the firing valve 302, the striker 304 and optionally either one of the spring 306 or the pneumatic cylinder 314. The bolt 16 is open in the position shown in FIG. 1*i*, and is closed in the position shown in FIG. 1*j*. In the position shown in FIG. 1*j*, the paintball is chambered and ready for firing.

Reference is made to FIGS. 1*g* and 1*h*, which show another alternative embodiment of the firing mechanism 300. In this embodiment, the firing mechanism 300 comprises a pneumatic valve 322. The pneumatic valve 322 includes a housing 324 and a spool 326. The housing 324 is generally elongate and may be more specifically generally cylindrical. The housing 324 has an inlet 328 and an outlet 330, which are spaced from each other longitudinally. The inlet 328 is connected fluidically to the high pressure firing air from the primary regulator (not shown). The outlet 330 is connected fluidically to the bolt 16 (FIG. 1*a*) to convey firing air to a chambered paintball 12.

First and second housing sealing surfaces 332 and 334 extend on projections 332*a* and 334*a*, into the interior of the housing 324 from its inside wall 335. The housing sealing 332 and 334 may extend about the entire circumference of the housing 324. The first and second housing sealing surfaces 332 and 334 are positioned longitudinally between the inlet 328 and outlet 330, and are at selected longitudinal distances from each other in the housing 324.

The spool 326 is elongate and may be generally cylindrical. The spool 326 is movable in the housing 324 and extends through at least one end of the housing 324 to the exterior thereof. The spool 326 includes first and second spool sealing surfaces 336 and 338, which extend outwardly on projections 336*a* and 338*a*, from the spool exterior surface, shown at 340. The first and second spool sealing surfaces 336 and 338 may be spaced from each other by a distance that differs from the distance between the housing sealing surfaces 332 and 334. The spool 326 is movable in the housing between a first position (see FIG. 1*g*) wherein the first spool and housing sealing surfaces 336 and 332 align and seal, and a second position (see FIG. 1*h*), wherein the second spool and housing sealing surfaces 338 and 334 align and seal.

In the position shown in FIG. 1*g*, high pressure firing air is permitted into a space 342 defined between the two housing sealing surfaces 332 and 334, but is prevented from flowing out of the pneumatic valve outlet 330 by the seal formed by the second sealing surfaces 334 and 338. The space 342 communicates with a firing air storage chamber 344. Accordingly, high pressure firing air fills the storage chamber 344 when the valve 322 is in the position in FIG. 1*g*. In the position shown in FIG. 1*h*, the high-pressure firing air is permitted to flow from the storage chamber 344, though the space 342, out the valve outlet 330 and into the bolt 16 for firing the paintball 12. The firing air is prevented from backflowing out the valve inlet 328 by the seal formed by the first spool and housing sealing surfaces 336 and 332.

The air storage chamber 344 shown in FIGS. 1*g* and 1*h* stores a selected volume of air for use in firing a paintball 12. The chamber 344 has an adjustment member 348 connected thereto for adjusting the overall contained volume of the chamber 344. This permits a player to adjust the volume of air used for each shot, thereby controlling the number of shots available in the air tank 400 (FIG. 1*i*). Furthermore, when too much air is released during a shot, some of that air is released after the paintball is ejected from the marker, and therefore, some portion of that air is wasted. Accordingly, providing adjustability to the volume of the air storage chamber 344 permits a player to find the lowest volume at which the velocity of the fired paintball 12 is substantially unchanged. Thus, the number of shots per tank can be maximized for any given firing velocity.

The adjustment member 348 is preferably infinitely adjustable between over a range of adjustment. To provide infinite adjustability, the adjustment member 348 may, for example, include a threaded insert that sealingly engages a threaded aperture 349 in the air storage chamber 344. The volume of the chamber 344 can thus be controlled by screwing in or screwing out of the adjustment member 348. The adjustment member 348 is preferably adjustable by hand without the need for tools, to facilitate volume adjustment.

Figure 16:
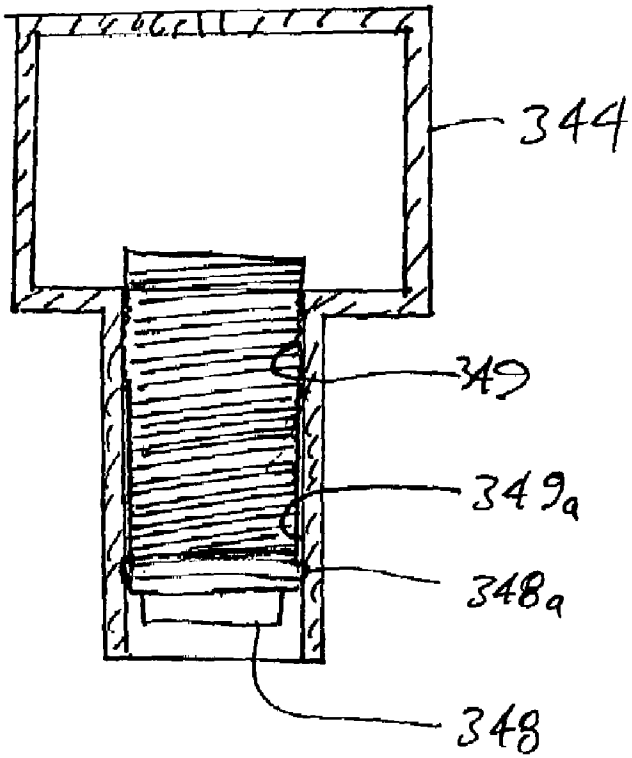
FIG. 16 shows a sectional side view of an air storage chamber and adjustment member shown in FIGS. 1*g* and 1*h*.

Referring to FIG. 16, the adjustment member 348 may include a sealing element 348*a*, which mates with a sealing surface 349*a* adjacent the threaded aperture 349. This provides a seal between the adjustment member 348 and the chamber 344 regardless of the position of the adjustment member 348.

The inlet 328 and outlet 330 on the pneumatic valve 322 may be of relatively large size on the valve 322, thereby reducing pressure drop therethrough, reducing the amount of time required to fill the firing air storage chamber 344 with firing air, and reducing the amount of time to release the firing air contained in the air storage chamber 344. One reason that the inlet 328 and outlet 330 may be sized relatively large, lies in the configuration of the sealing surfaces 332, 334, 336 and 338. Because the sealing surfaces 334 and 338 on the spool 326 do not engage or sweep past the inlet 328 or outlet 330, as they do on other types of spool valve, the inlet 328 and outlet 330 may be made relatively large without impacting the overall stroke required by the spool 326 to open or close the valve 322. The large inlet 328 and outlet 330 reduce the pressure drop thereacross, which increases the firing efficiency of the marker 10, in that less energy is lost during passage of firing air from the air storage chamber to the bolt 16. Furthermore a large inlet 328 and a large outlet 330 also reduce the amount of time required to fill the air storage chamber 344 to its target pressure, and also analogously reduces the amount of time required for the firing air to leave the air storage chamber 344.

By contrast, spool valves that incorporate sealing surfaces that sweep past the valve inlet and valve outlet (such as the spool valve 38 shown in FIGS. 3*a* and 3*b*) typically have relatively small inlet and outlet apertures in an effort to reduce the actuation stroke and thus the actuation time of the spool. The small inlet and outlet of such spool valves typically provide a relatively high pressure drop, and increase the amount of time required for a selected volume of air to pass through them for firing a paintball.

The spool 326 requires a relatively short stroke to move between the first or filling position shown in FIG. 1*g* and the second or firing position shown in FIG. 1*h*. The short stroke required makes the actuation of the pneumatic valve 322 relatively quick compared to valves that have longer travel between the closed and open positions.

The quick actuation of the valve 322 makes for an overall quicker firing of the paintball 12 from the time the trigger 92 is pulled. Furthermore, the overall cycle time to complete a firing of the paintball 12, which makes the marker 10 capable of an increased firing frequency.

The sealing surfaces 332 and 334, and 336 and 338 may have several configurations. For example, referring to FIG. 17*a*, the sealing surfaces 332 and 334 may be generally cylindrical, and the sealing surfaces 336 and 338 may be generally toroidal (ie. O-ring shaped). In this configuration, the seals are formed by sliding the sealing surfaces 336 and 338 within the cylindrical sealing surfaces 332 and 334.

Figure 17C:
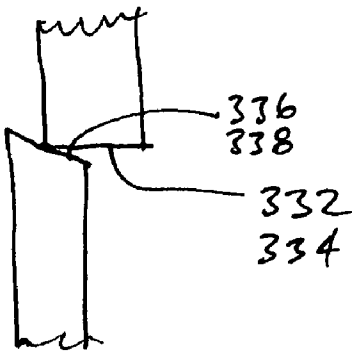
FIGS. 17*a*, 17*b*, 17*c*, 17*d* and 17*e* show alternative configurations for sealing surfaces on the firing valve shown in FIGS. 1*g*, and 1*h;*
Figure 17B:
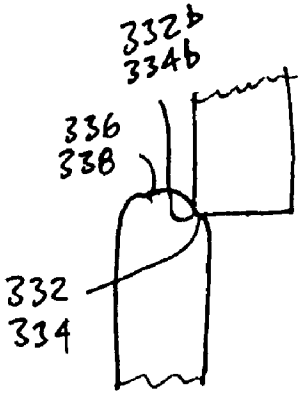

Referring to FIG. 17*b*, the sealing surfaces 332 and 334 may have edges 367*b*, 368*b*, 369*b* and 370*b* respectively. In this alternative, the sealing surfaces 336 and 338 are configured to engage the edges 367*b*, 368*b*, 369*b* and 370*b* and form a seal therewith. The sealing surfaces 336 and 338 may be generally toroidal (ie. O-ring shaped). Alternatively, they may have another configuration, such as, for example, a generally frusto-conical configuration as shown in FIG. 17*c*.

Figure 17D:
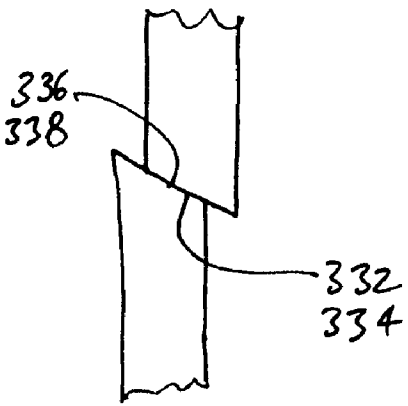

Referring to FIG. 17*d*, the sealing surfaces 336 and 338 and 332 and 334 may all be frusto-conical, thereby mating to form seals with more surface-to-surface contact than the seal shown in FIG. 17*b* whereby a seal is formed incorporating surface-to-edge contact.

Figure 17A:
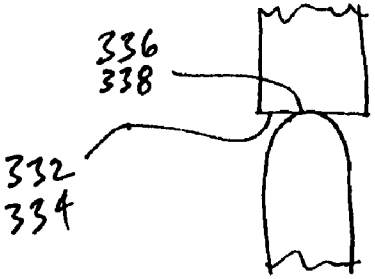
Figure 17E:
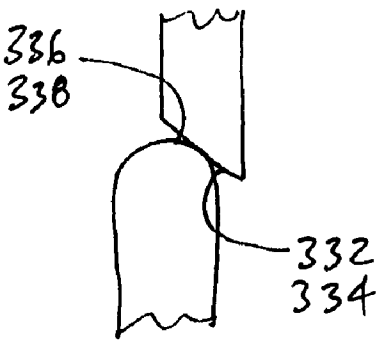

Referring to FIG. 17*e*, the sealing surfaces 332 and 334 may be frusto-conical and the sealing surfaces 336 and 338 may be generally toroidal (ie. o-ring shaped). In this way, seals are formed without the need for matching of cone angles on the mating sealing surfaces.

In the configuration shown in FIG. 17*a*, the seals are formed between the sealing surfaces 336 and 338 and 332 and 334 by sliding contact between the mating pairs of sealing surfaces.

In the configurations shown in FIGS. 17*b*, 17*c*, 17*d* and 17*e*, the seals may be formed between the sealing surfaces 336 and 338 and 332 and 334 with reduced sliding contact than occurs in the embodiment shown in FIG. 17*a*. Accordingly, less energy may be required to move the spool 360 from one position to another, to form seals between selected pairs of sealing surfaces. Furthermore, less wear may occur between the sealing surfaces as a result of the reduced sliding contact therebetween. Configurations such as those shown in FIGS. 17*b*, 17*c*, 17*d* and 17*e* may be referred to as poppet-style spool valve configurations.

The trigger 92 may be operatively connected to the spool 326 for movement of the spool 326 in the housing 324, by any suitable means. For example, the trigger 92 may be connected to the spool 326 by one or more of a mechanical linkage, a pneumatic connection, an electric solenoid, and an electronic solenoid valve.

Figure 10A:
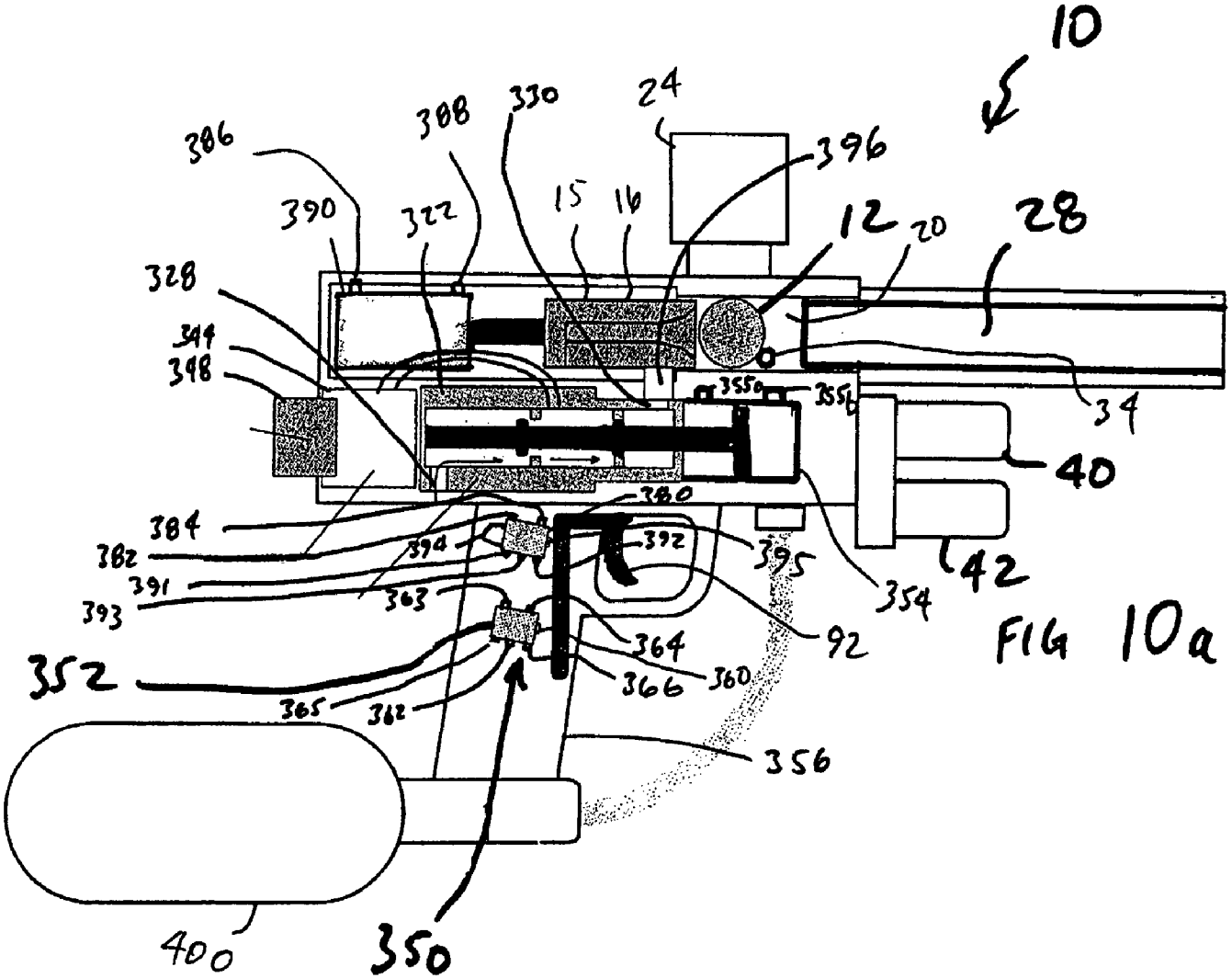
FIGS. 10*a*, 10*b* and 10*c* are side views of a marker in accordance with another embodiment of the invention, illustrating the operation of an optional linkage between a trigger with the firing mechanism shown in FIGS. 1*g* and 1*h*, and an optional linkage between the trigger and a bolt on the marker.
Figure 10B:
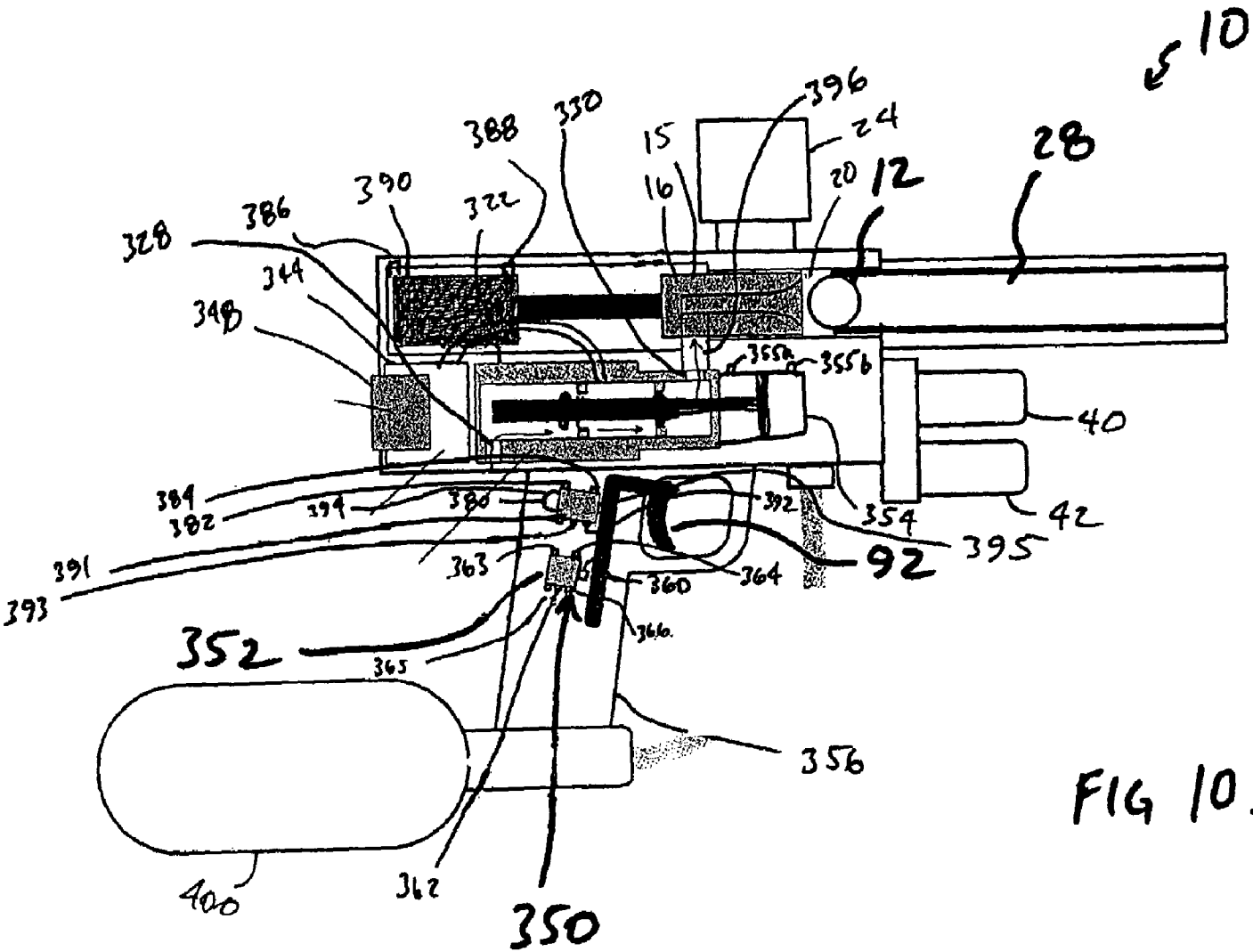
Figure 10C:
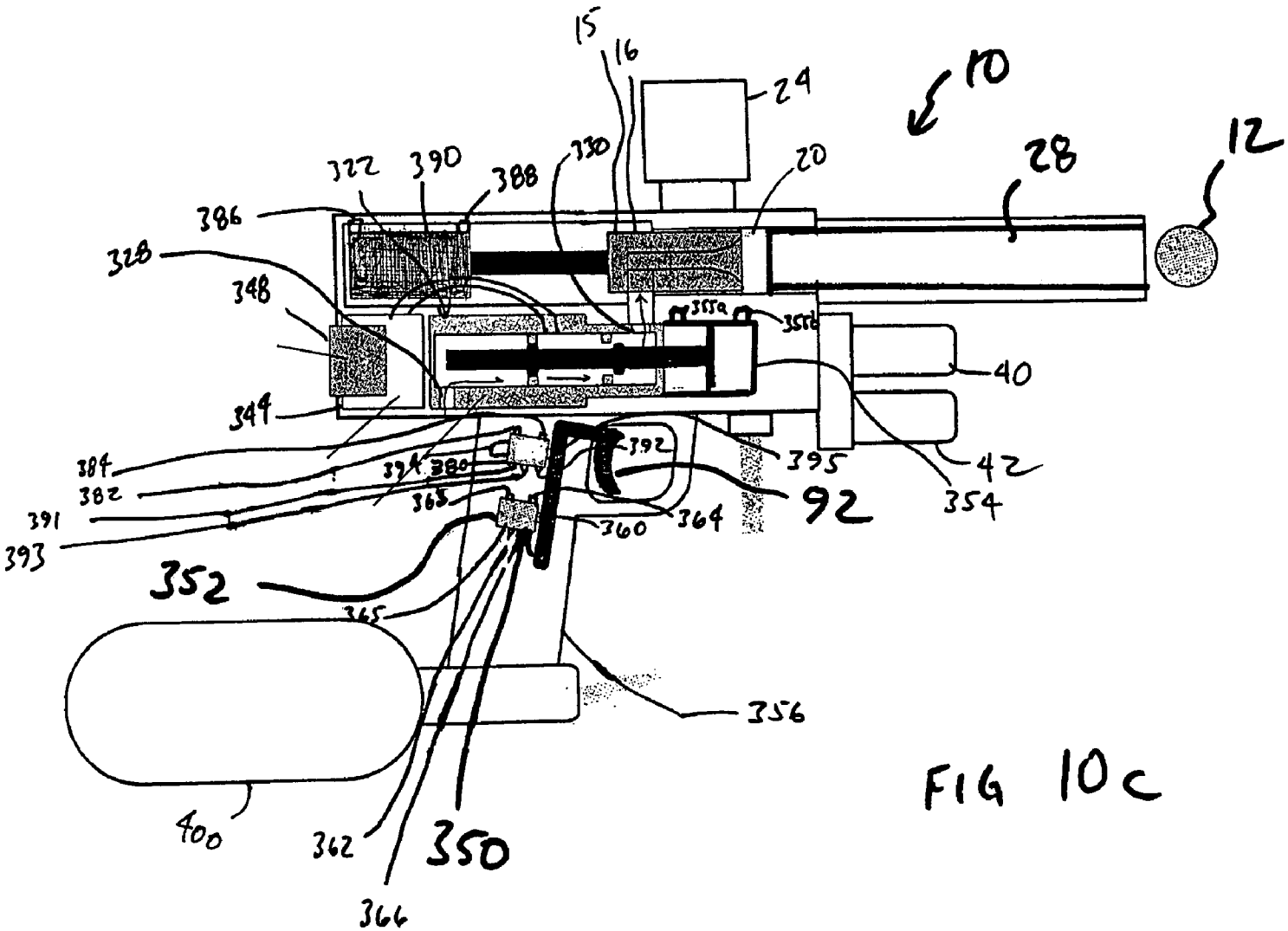

An exemplary linkage 350 between the trigger 92 and the firing mechanism 300 is shown in FIGS. 10*a*, 10*b* and 10*c*. The linkage 350 includes a firing valve actuation valve 352. The firing valve actuation valve 352 is configured to selectively direct air from the first low pressure regulator 40 to an actuator 354 that may be, for example, a pneumatic cylinder 354, that is operatively connected to the spool 326 of the firing valve 322. The cylinder has a first port 355*a* and a second port 355*b*.

Figure 11A:
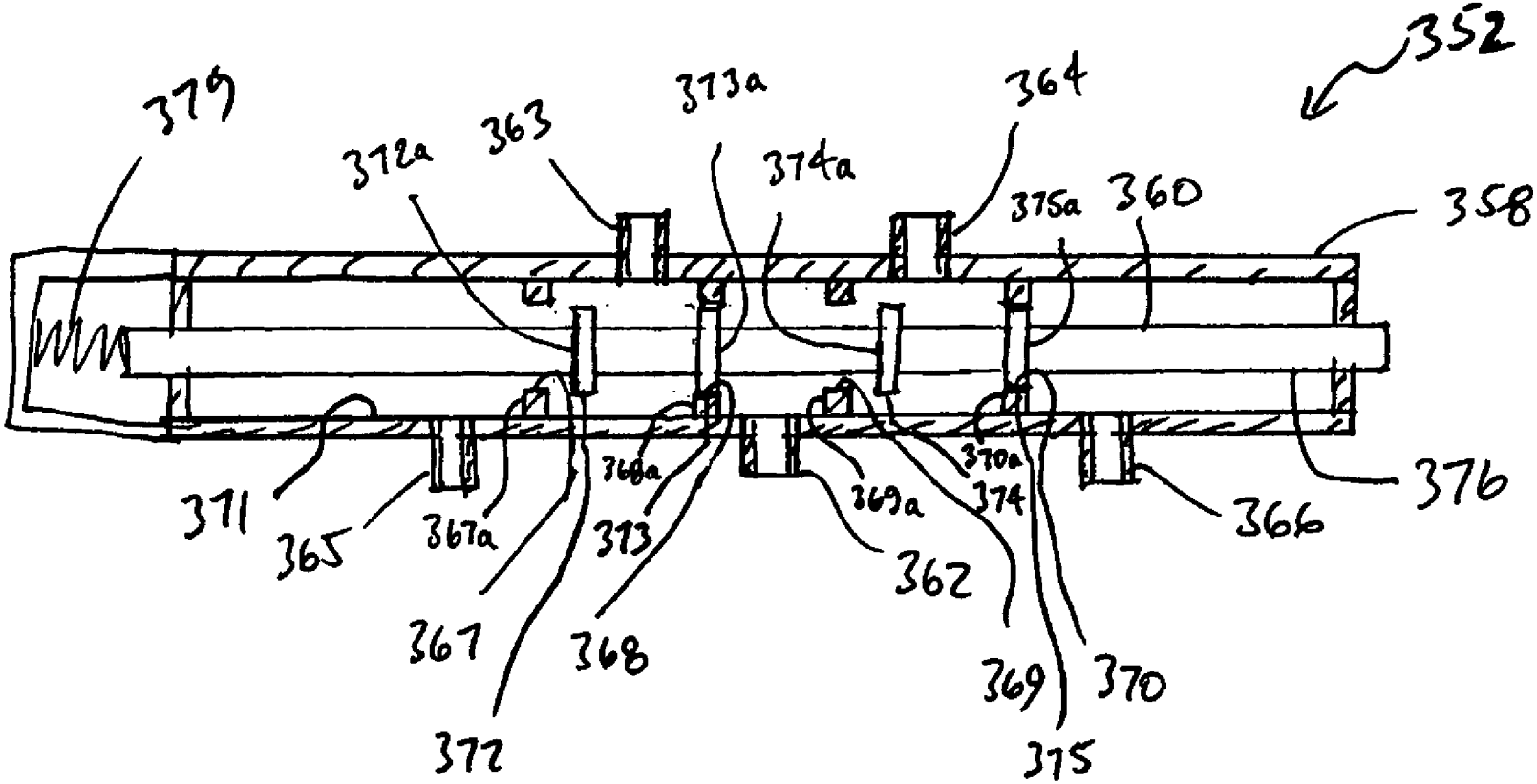
FIGS. 11*a* and 11*b* are magnified sectional side views illustrating the operation of a control valve that is part of one of the linkages shown in FIGS. 10*a*, 10*b* and 10*c;*
Figure 11B:
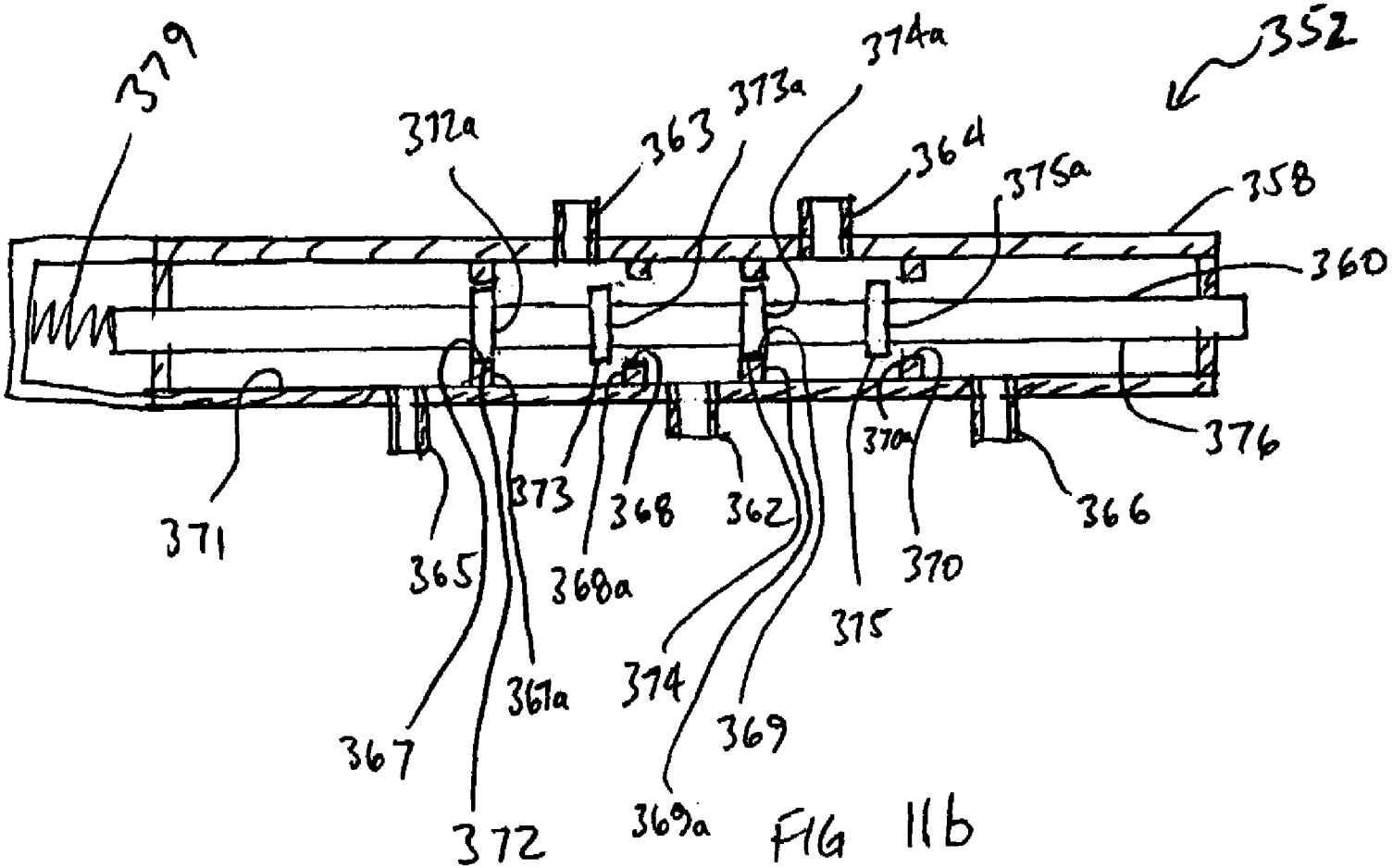

Preferably, the firing valve actuation valve 352 is sized to fit within the grip of the marker 10, shown at 356. The firing valve actuation valve 352 may be configured similarly to the firing valve 322, in that it contains sealing surfaces that do not sweep past the inlet and outlet ports. Referring to FIGS. 11*a* and 11*b*, the firing valve actuation valve 352 includes a housing 358 and an elongate valve spool 360 that is positionable in a first position or non-firing position (FIG. 11*a*) and a second position or firing position (FIG. 11*b*). The housing 358 is generally elongate and may be more specifically generally cylindrical. The housing 358 has an inlet 362 and two outlets 363 and 364, one on either side of the inlet 362. The housing 358 also has two exhausts 365 and 366, which may be the two outermost ports on the housing 358.

The inlet 362 is connected fluidically to air from the first low pressure regulator 40 (see FIG. 10*a*—the fluid path from the regulator 40 to the inlet 362 is not shown, however). The outlets 363 and 364 are connected fluidically to the two ports 355*a* and 355*b* respectively on the pneumatic cylinder 354 for actuating the cylinder and in turn the spool 326 on the firing valve 322, (the fluid paths from the outlets 363 and 364 to the ports 355*a* and 355*b* on the pneumatic cylinder 354 are not shown).

The housing has first, second, third and fourth housing sealing surfaces 367, 368, 369 and 370, which are positioned on circumferential projections 367*a*, 368*a*, 369*a* and 370*a* respectively, which project into the interior of the housing 358 from its inside wall 371. The housing sealing surfaces 367, 368, 369 and 370 extend about the entire circumference of the housing 358. The sealing surface 367 is positioned longitudinally between the first exhaust port 365 and the first outlet 363. The sealing surface 368 is positioned longitudinally between the first outlet 363 and the inlet 362. The sealing surface 369 is positioned longitudinally between the inlet 362 and the second outlet 364. The sealing surface 370 is positioned longitudinally between the second outlet 364 and the second exhaust port 366. The sealing surfaces 367, 368, 369 and 370 are positioned at selected longitudinal distances from each other in the housing 358.

The spool 360 is elongate and may be generally cylindrical. The spool 360 is movable in the housing 358 and extends through at least one end of the housing 358 to the exterior thereof. The spool 360 includes first, second, third and fourth spool sealing surfaces 372, 373, 374 and 375, which are positioned on ring-shaped projections 372*a*, 373*a*, 374*a* and 375*a*, which extend outwardly from its exterior surface, shown at 376. The spool sealing surfaces 372, 373, 374 and 375 are positioned on the spool 360 at a selected spacing so that, when the spool 360 is in a firing position (see FIG. 11*b*), the first sealing surfaces 367 and 372 engage and the third sealing surfaces 369 and 374 engage. Air from the first low pressure regulator 40 passes through the inlet 362 and through the first outlet 363 to the first cylinder port 355*a*. Simultaneously air passes from the cylinder port 355*b* into the valve 352 through the second outlet 364 and out through the second exhaust 366. Thus, the cylinder 354 is actuated in a direction which operates the firing valve 322 to fire a paintball 12.

When the spool 360 is in the non-firing position (see FIG. 11*a*), the second sealing surfaces 368 and 373 engage and the fourth sealing surfaces 370 and 375 engage. Air from the first low pressure regulator 40 passes through the inlet 362 and through the second outlet 364 to the second cylinder port 355*b*. Simultaneously air passes from the cylinder port 355*a* into the valve 352 through the first outlet 363 and out through the first exhaust 365. Thus, the cylinder 354 is actuated in a direction which returns the firing valve 322 to its non-firing position for filling the air storage chamber 344.

The inlet 362, outlets 363 and 364, and exhaust ports 365 and 366 may be of relatively large size, thereby reducing pressure drop therethrough, and reducing the actuation time for the cylinder 354 by reducing resistance (ie. pressure drop) to air passing therethrough. The reasons for this are the same as the reasons provided above in relation to the valve 322.

Furthermore, the valve 352 requires a relatively short stroke of the spool 360 to move the spool 360 between the non-firing position shown in FIG. 11*a* and the firing position shown in FIG. 11*b*, for the same reasons as explained above in relation to the valve 322. Accordingly, the actuation time of the valve 352 is reduced as a result of the short stroke.

The quick actuation of the valve 352 makes for an overall quicker actuation of the pneumatic cylinder 354. Because the valve 352 transmits the pulling of the trigger 92 to the valve 322 more quickly, the overall actuation of the firing valve 322 is quicker, which contributes to reducing the overall cycle time to complete a firing of the paintball 12 from the pulling of the trigger 92. The reduced firing cycle time makes for an increased firing frequency capability for the marker 10.

The sealing surfaces 367, 368, 369 and 370, and 372, 373, 374 and 375 may have several configurations. For example, referring to FIG. 15*a*, the sealing surfaces 367, 368, 369 and 370 may be generally cylindrical, and the sealing surfaces 372, 373, 374 and 375 may be generally toroidal (ie. O-ring shaped). In this configuration, the seals are formed by sliding the sealing surfaces 372, 373, 374 and 375 within the cylindrical sealing surfaces 367, 368, 369 and 370.

Figure 15C:
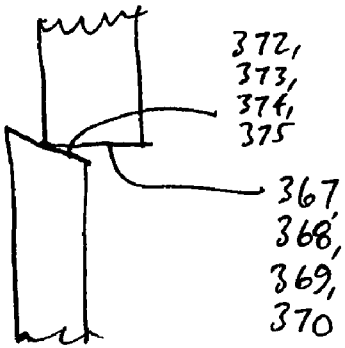
FIGS. 15*a*, 15*b*, 15*c*, 15*d* and 15*e* show alternative configurations for sealing surfaces on control valves shown in FIGS. 10*a*, 10*b*, 10*c*, 11*a* and 11*b;*
Figure 15B:
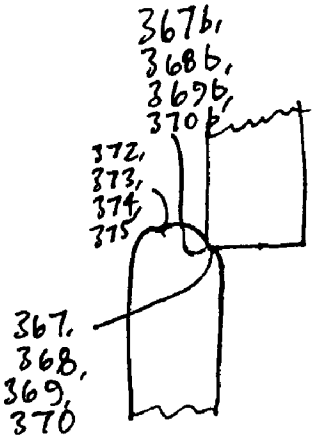

Referring to FIG. 15*b*, the sealing surfaces 367, 368, 369 and 370 may have edges 367*b*, 368*b*, 369*b* and 370*b* respectively. In this alternative, the sealing surfaces 372, 373, 374 and 375 are configured to engage the edges 367*b*, 368*b*, 369*b* and 370*b* and form a seal therewith. The sealing surfaces 372, 373, 374 and 375 may be generally toroidal (ie. O-ring shaped). Alternatively, they may have another configuration, such as, for example, a generally frusto-conical configuration as shown in FIG. 15*c*.

Figure 15D:
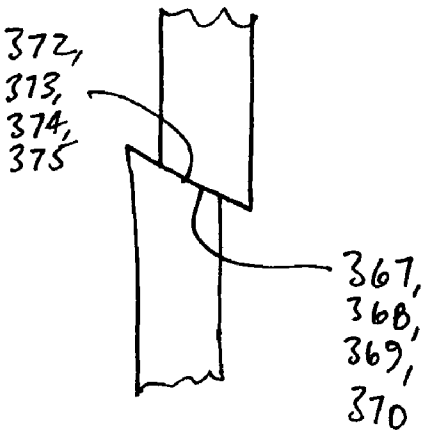

Referring to FIG. 15*d*, the sealing surfaces 372, 373, 374 and 375 and 367, 368, 369 and 370 may all be frusto-conical, thereby mating to form seals with more surface-to-surface contact than the seal shown in FIG. 15*b* whereby a seal is formed incorporating surface-to-edge contact.

Figure 15A:
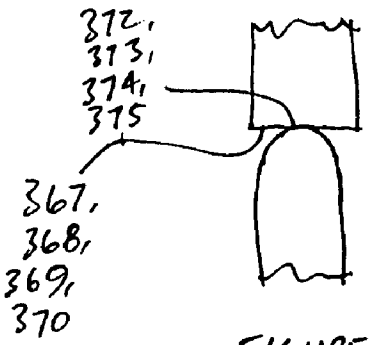
Figure 15E:
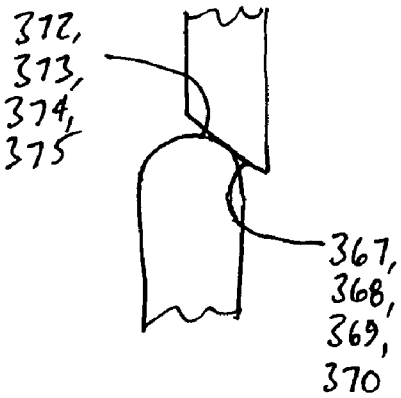

Referring to FIG. 15*e*, the sealing surfaces 367, 368, 369 and 370 may be frusto-conical and the sealing surfaces 372, 373, 374 and 375 may be generally toroidal (ie. o-ring shaped). In this way, seals are formed without the need for matching of cone angles on the mating sealing surfaces.

In the configuration shown in FIG. 15*a*, the seals are formed between the sealing surfaces 372, 373, 374 and 375 and 367, 368, 369 and 370 by sliding contact between the mating pairs of sealing surfaces.

In the configurations shown in FIGS. 15*b*, 15*c*, 15*d* and 15*e*, the seals may be formed between the sealing surfaces 372, 373, 374 and 375 and 367, 368, 369 and 370 with reduced sliding contact than occurs in the embodiment shown in FIG. 15*a*. Accordingly, less energy may be required to move the spool 360 from one position to another, to form seals between selected pairs of sealing surfaces. Furthermore, less wear may occur between the sealing surfaces as a result of the reduced sliding contact therebetween. Configurations such as those shown in FIGS. 15*b*, 15*c*, 15*d* and 15*e* may be referred to as poppet-style spool valve configurations.

Referring to FIGS. 10*a* and 10*c* particularly, the spool 360 may be configured to be directly engaged by the trigger 92. In other words, when it is desired to fire a paintball 12, the trigger 92 is pulled. Pulling the trigger 92 brings the trigger 92 into engagement with the spool 360 and moves the spool 360 to actuate the pneumatic cylinder 354, which in turn actuates the firing valve 322.

The valve 352 may include a biasing mechanism 379 for biasing the spool 360 in the position shown in FIG. 11*b*, so that the firing valve 322 is positioned in the filling position.

The pneumatic cylinder 354 may be operatively connected to the spool 326 of the firing valve 322 in any suitable way. For example, the cylinder 354 may be integrally formed with the firing valve 322.

As shown in FIGS. 10*a*, 10*b* and 10*c*, the marker 10 may further include a bolt-actuating valve 380 instead of the bolt-actuating valve 38. The bolt-actuating valve 380 may be actuated directly from the trigger 92 in a manner similar to the valve 352. It is preferable for the valve 380, like the valve 352, to be positioned in the grip 356 of the marker 10, however, it is alternatively possible for the valve 380 to be positioned elsewhere within the marker 10.

The valve 380 may be similar in configuration to the valve 352, except that the outputs of the valve 380, shown at 382 and 384 are connected fluidically to the ports 386 and 388 on the pneumatic cylinder 390. The pneumatic cylinder 390 is operatively connected to the bolt 16. The valve may also include two exhaust ports 391 and 392, which are associated with the outlet ports 382 and 384 respectively.

The valve 380 may be configured to have a single input 393, as shown in FIGS. 10*a*, 10*b* and 10*c*. The input 393 may be fluidically connected to the second low pressure regulator 42 (connection not shown). When the valve 380 is in a first position, air from the second regulator 42 is directed through the inlet 393, out through the second outlet 384 and into the cylinder 390 through the port 388. In this position, air is also permitted to pass from the cylinder port 386, into the first valve 380 through the first outlet 382 and out through the first exhaust port 391. In this position, the cylinder 390 is driven to move the bolt 16 to an open position, permitting entry of a paintball 12 into the breech 20.

When the valve 380 is positioned in a second position, air from the second regulator 42 is directed through the inlet, out through the first outlet 382 and into the cylinder 390 through the port 386. In this position, air is also permitted to pass from the cylinder port 388, into the first valve 380 through the second outlet 384 and out through the second exhaust port 392. In this position, the cylinder 390 is driven to move the bolt 16 to a closed position, thereby chambering a paintball 12. It will be noted that the valve 380 configured as shown in FIGS. 10*a*, 10*b* and 10*c* uses air from the second low pressure regulator 42 to move the bolt 16 to both the open and closed positions. The valve 352 uses air from the first low pressure regulator 40 to control the firing valve 322. In embodiments wherein air from regulator 42 is used to control bolt movement and air from regulator 40 is used to control the firing valve 322, or any other firing valve, the linkages used to control the bolt and firing valve may be mechanical, pneumatic, electrical, electronic or any combination thereof. Regardless of what is used to operatively link the trigger 92 to the firing mechanism 300, and what is used to operatively link the trigger 92 to the bolt 16, it is advantageous to operate with air from the second regulator 42 to close the bolt 16 and to operate the firing mechanism with air from the first regulator 40. The bolt 16 may also moved to the open position using air from the second regulator 42.

For quick actuation and good reliability, however, it is preferable to use at least one of the valves 322, 352 and 380 in the marker 10. Preferably, all three may be included in the marker 10 to control both the firing and the bolt movement without using solenoids.

The valve 380 may include a biasing mechanism 394 for biasing the valve 380 in either the first or second positions. Accordingly, the biasing mechanism effectively biases the bolt in either the bolt-open or bolt-closed positions. In the system shown in FIGS. 10*a*, 10*b* and 10*c*, the valve 380 when not actuated by the trigger 92 (see FIG. 10*a*) is in the first position, whereby the bolt 16 is open. When the marker 10 is configured this way, it may be referred to as an open bolt marker 10.

The valve 380 may advantageously incorporate any of the configurations of sealing surfaces 372, 373, 274 and 375, and 367, 368, 369 and 370 shown in FIGS. 15*a*, 15*b*, 15*c*, 15*d* and 15*e*.

Referring to FIG. 10*b*, when the trigger 92 is first pulled, it first engages the spool of the valve 380, which is shown at 395. The valve 380 is moved to its second position, thereby moving the bolt 16 forward to chamber the paintball 12. As the trigger 92 is pulled further, the valve 352 is engaged (see FIG. 3), thereby firing the paintball 12 from the marker 10.

It will be noted that until the bolt 16 has chambered the paintball 12, the fluid path, shown at 396, from the firing valve 322 into the bolt 16 is closed (see FIGS. 10*a*, 10*b* and 10*c*).

Releasing the trigger 92 returns the valves 352 and 380 to their rest positions. The bolt 16 returns to the open position to permit another paintball 12 into the breech 20. The firing valve 322 returns to the filling position for filing the air storage chamber 344.

It is alternatively possible for the marker 10 shown in FIGS. 10*a*, 10*b* and 10*c* to be a closed bolt design. In a closed bolt design, the bolt 16 remains in at rest in the closed position. Thus, when the trigger 92 is pulled the valve 352 would be actuated first instead of the valve 380, thereby firing the paintball 12. Then, as the trigger 92 is pulled further, the valve 380 is actuated to move to its first position which would move the bolt to its open position for receiving another paintball 12 in the breech 20. When the trigger 92 would be released, the valve 380 would return to its second position, closing the bolt 16 and chambering another paintball 12. In this alternative embodiment, the valve 380 would be biased towards its second position. The valve 352 would still be biased towards its first position, for filling the air storage chamber 344.

By incorporating the aforementioned quick-acting, high air flow pneumatic valves 322, 352 and 380 and by operating the actuation valves 352 and 380 directly from the trigger 92 without the use of a solenoid, the performance of the marker 10 in terms of firing frequency remains good, without incurring the drawbacks associated with having solenoids and their attendant power delivery and electrical systems. For example, the marker 10 shown in FIGS. 10*a*, 10*b* and 10*c* does not require a battery, and accordingly is not at risk of stranding a player as a result of a dead or weak battery. Furthermore, by eliminating the solenoids and associated electrical systems, the marker 10 can be operated with reduced risk of damage during wet, hot or cold playing conditions, all of which pose a risk to electrical components.

In the embodiment shown in FIGS. 10*a*, 10*b* and 10*c*, the marker 10 included a pneumatic valve 322 as the firing valve. Referring to FIGS. 12*a*, 12*b*, 12*c* and 12*d*, it is alternatively possible for the marker 10 to include the firing valve 302 and, for example, the pneumatic cylinder 314. The valve 352 may be used to operate the cylinder 314 in similar manner to the operation of the cylinder 354 in the embodiment shown in FIGS. 10*a*, 10*b* and 10*c*.

Figure 12A:
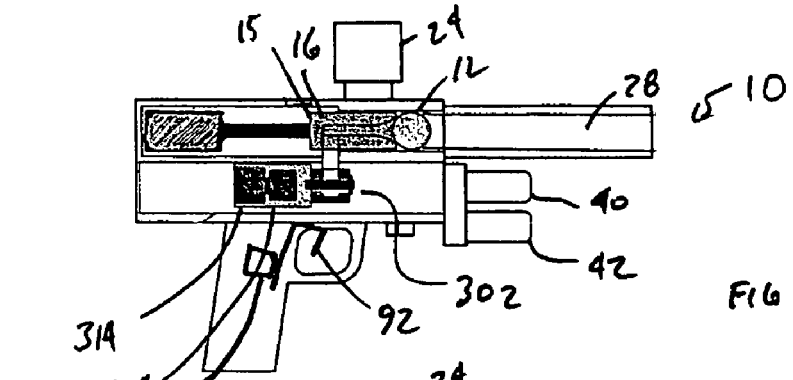
FIGS. 12*a*, 12*b*, 12*c* and 12*d* are side views that illustrate the marker shown in FIG. 10*a*, with the alternative firing mechanism shown in FIGS. 1*e* and 1*f*, in a closed bolt configuration.
Figure 12B:
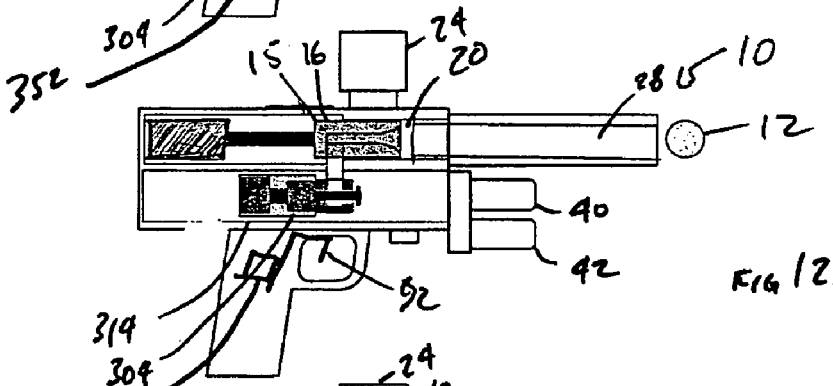
Figure 12C:
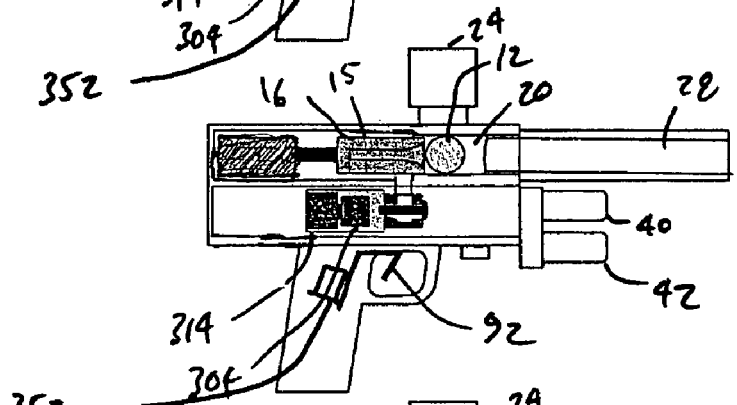
Figure 12D:
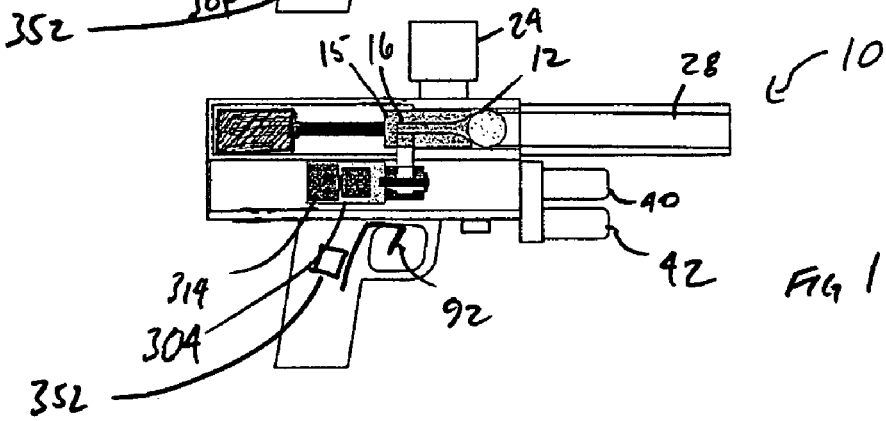

The embodiment shown in FIGS. 12*a*, 12*b*, 12*c* and 12*d* is a closed bolt marker. Thus, the valve (not shown) that actuates the bolt 16 is biased in a position for closing the bolt 16 (see FIG. 12*a*). When the trigger 92 is pulled, a valve (not shown) actuates the cylinder 314 and a paintball 12 is fired from the marker 10 (see FIG. 12*b*). The firing air may be sent to the bolt 16 from an air storage chamber 344 (FIG. 1*g*), through the firing valve 302. The bolt 16 is then opened to permit entry of another paintball 12 into the breech 20 (FIG. 12*c*). The bolt 16 is then closed thereby chambering the new paintball 12 (FIG. 12*d*).

Figure 13A:
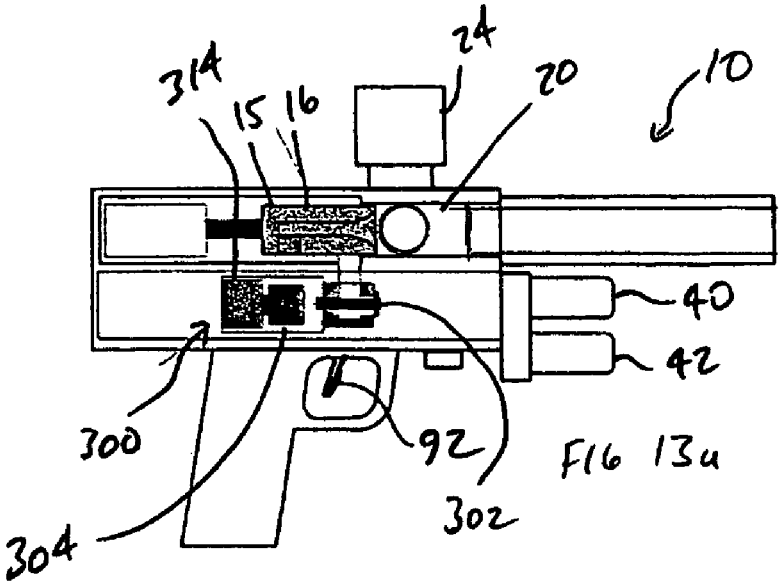
FIGS. 13*a*, 13*b* and 13*c* are side views that illustrate the marker shown in FIG. 10*a*, with the alternative firing mechanism shown in FIGS. 1*e* and 1*f*, in an open bolt configuration.
Figure 13B:
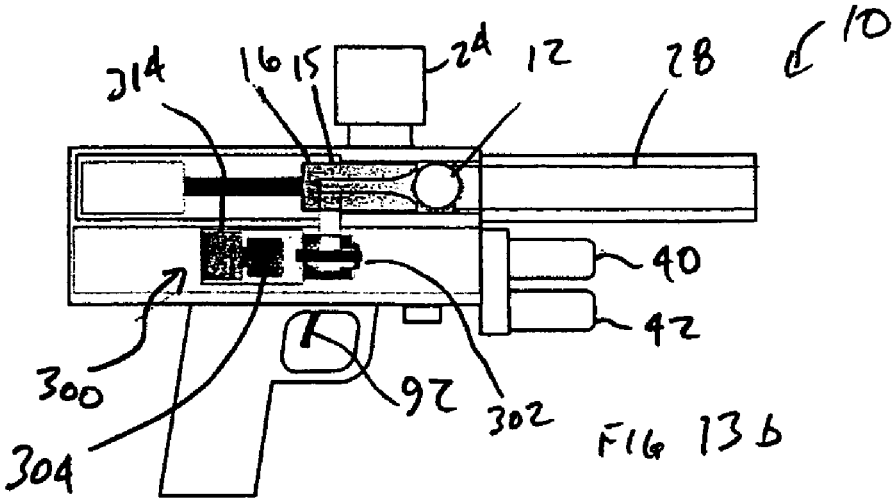
Figure 13C:
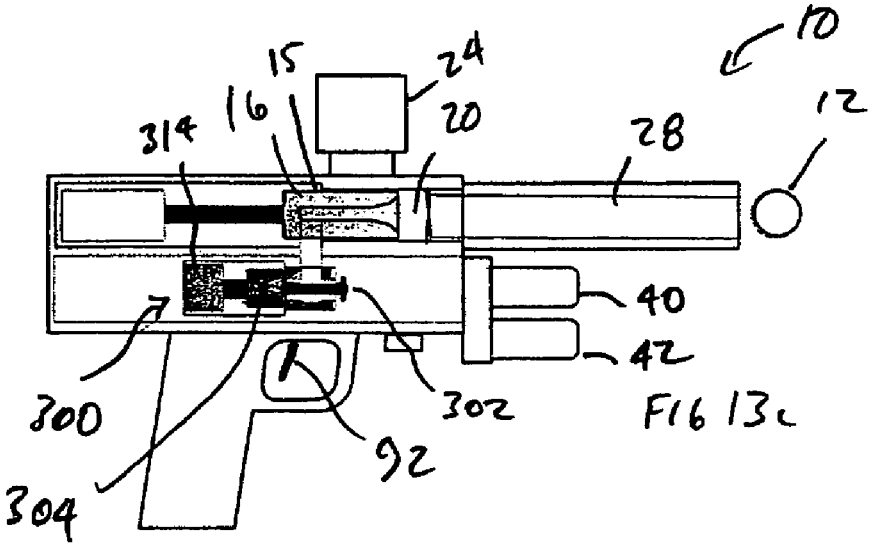

Reference is made to FIGS. 13*a*, 13*b* and 13*c*, which illustrate the operation of the marker 10 with the firing valve 302 and the pneumatic cylinder 314 in an open bolt configuration. Prior to pulling the trigger 92, the bolt 16 is open and a paintball 12 is in the breech 20. When the trigger 92 is pulled, the bolt 16 is closed thereby chambering the paintball 12 (see FIG. 13*b*). A valve (not shown) actuates the cylinder 314 and the chambered paintball 12 is fired from the marker 10 (see FIG. 13*c*). The firing air may be sent to the bolt 16 from an air storage chamber 344 (FIG. 1*g*), through the firing valve 302. The bolt 16 is opened to permit entry of another paintball 12 into the breech 20 (FIG. 12*a*).

It will be noted that the embodiments shown in FIGS. 12*a*, 12*b*, 12*c* and 12*d* and 13*a*, 13*b* and 13*c* can be referred to as a two-tube configuration, in that the body 14 of the marker 10 includes two chambers, one housing the firing mechanism 300 and one housing the bolt 16 and bolt-actuating cylinder. It is alternatively possible for the marker 10 to have a one-tube or a three-tube configuration, or to incorporate any of the firing mechanisms disclosed herein.

Figure 14A:
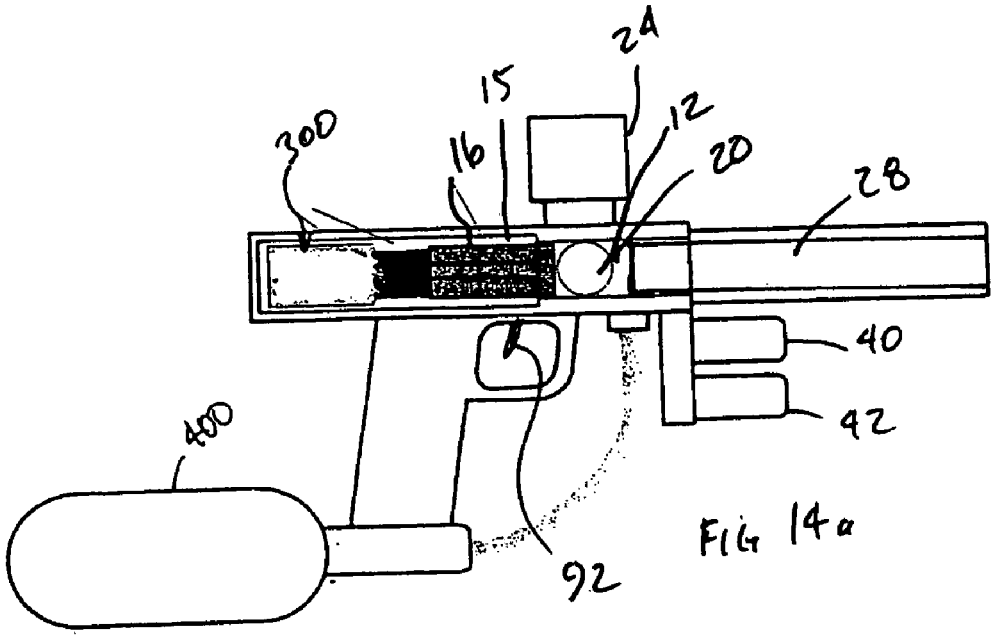
FIGS. 14*a* and 14*b* are side views of a marker in accordance with another embodiment of the invention, having a one tube configuration.
Figure 14B:
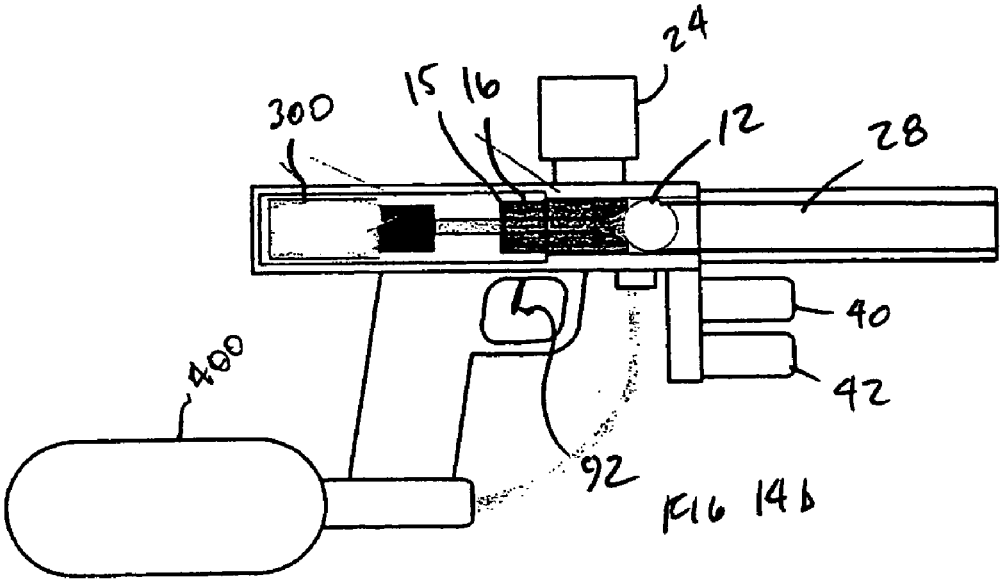

Reference is made to FIGS. 14*a* and 14*b*, which illustrate the operation of the marker 10 with the firing mechanism 300, the bolt 16 and the bolt-actuating cylinder all in-line. This is referred to as a single-tube or one-tube configuration.

Figure 4A:
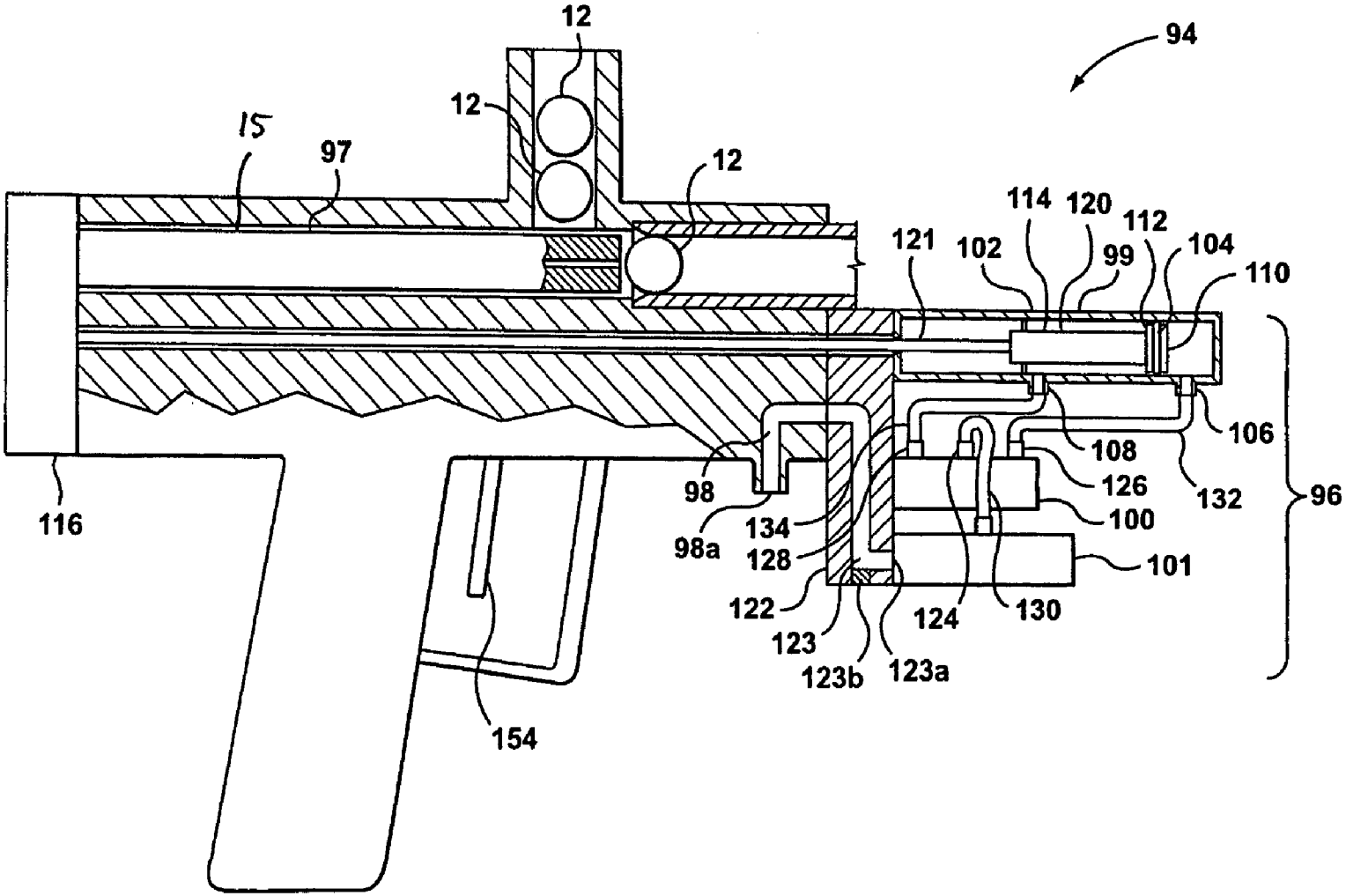
FIG. 4*a* is a partially sectional side view of a paintball marker in accordance with a second embodiment of the present invention, in a bolt-closed position.

Reference is made to FIG. 4*a*, which shows a paintball marker 94 in accordance with another embodiment of the present invention. The paintball marker 94 may be similar to the paintball marker 10, except that the paintball marker 94 incorporates an actuation system 96 instead of the actuation system 18 (see FIG. 1*a*).

Figure 4B:
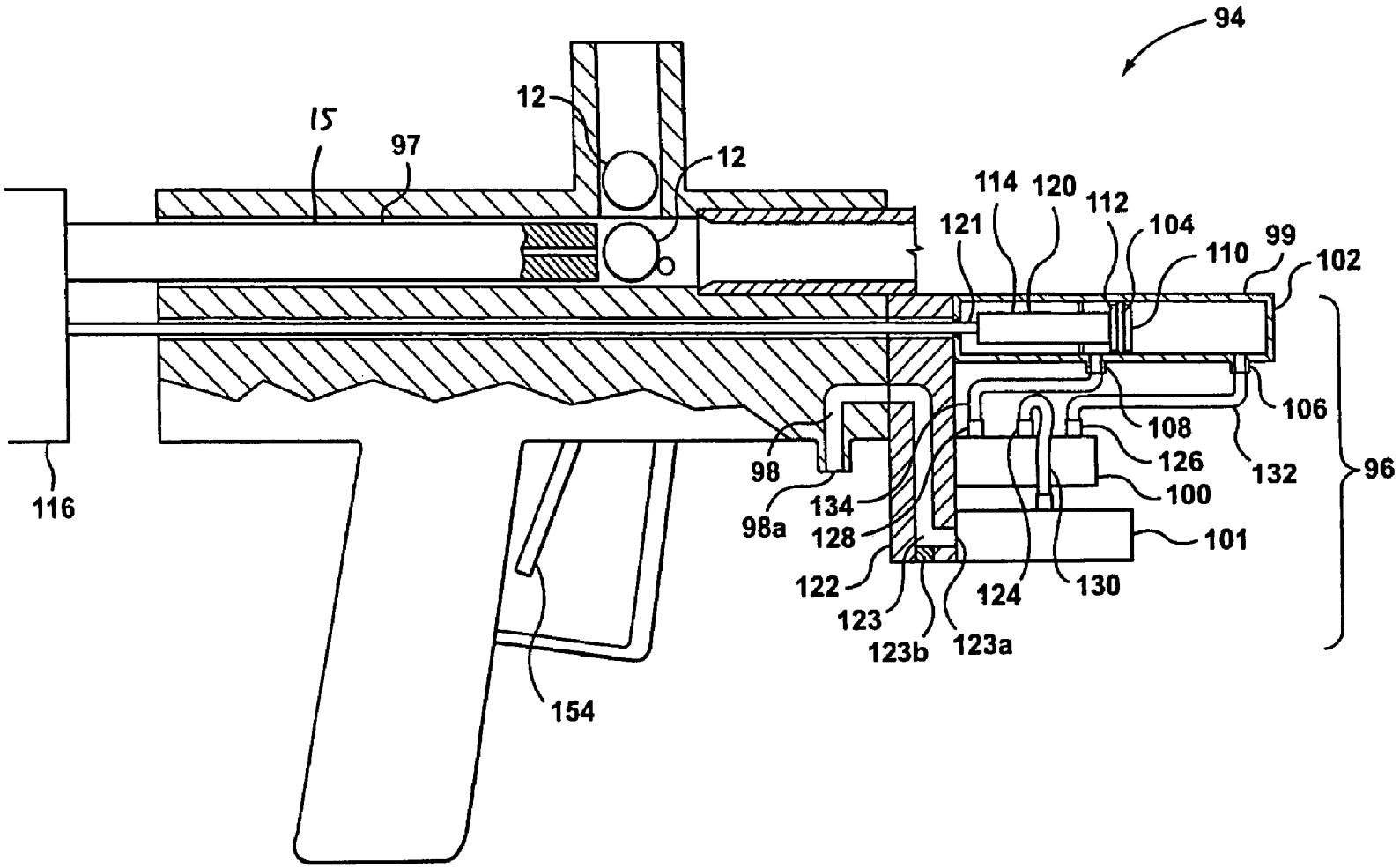
FIG. 4*b* is a partially sectional side view of the paintball marker shown in FIG. 4*a*, in a bolt-open position.

In similar fashion to the actuation system 18 (FIG. 1*a*), the actuation system 96 may utilize air pressure from a pressurized air tank 400 (see FIG. 1*i*), to drive a bolt 97 between open and closed positions (FIG. 4*b* and 4*a* respectively). A primary regulator (not shown) may be fluidically connected to the air tank 400 (FIG. 1*i*) to reduce the air pressure from the air tank 400 down to a pressure suitable for use in firing the paintball marker 94. The primary regulator (not shown) may be a single stage regulator, or alternatively may be a dual stage regulator, essentially consisting of two regulators in series to reduce the air pressure in two stages down to the firing pressure. The marker 94 includes an air conduit 98 for transporting air from the primary regulator (not shown) through an inlet 98*a*, to the firing mechanism (not shown) and to the actuation system 96.

The actuation system 96 includes a pneumatic cylinder 99, a control valve 100 and an actuation system regulator 101. The pneumatic cylinder 99 includes a housing 102 and a piston 104. The housing 102 may be similar to the pneumatic cylinder housing 44 (see FIG. 1*a*), and may have a first port 106 proximate its front end and a second port 108 proximate its rear end. The piston 104 is moveable within the housing 102 between a forwardmost position as shown in FIG. 4*a*, and a rearwardmost position, as shown in FIG. 4*b*.

The piston 104 has a front face 110 and a rear face 112. A rod 114 may be connected at a first end to the rear face 112 of the piston 104, and at a second end to a back plate 116. The back plate 116 may, in turn, be connected to the bolt 97. The rod 114 may be a two stage rod, and may have a front portion 120 and a rear portion 121. The front portion 120 is connected to the rear face 112 of the piston 104, and extends out of the rearwardmost end of the pneumatic cylinder housing 102. Thus, the pressure bearing surface area of the rear face 112 is smaller than the pressure bearing surface area of the front face 110, because of the surface area occupied on the rear face 112 by the front portion 120 of the rod 114. For example, if the front portion 120 of the rod 114 is generally cylindrical, the pressure bearing surface area on the rear face 112 will be an annulus having a surface area that is equal to the overall surface area of the rear face 112 minus the cross-sectional area of the front portion 120. It will be noted that, the front portion 120 of the rod 114 extends out of the housing 102, throughout the range of motion of the piston 104. This provides a constant pressure bearing surface area on the rear face 112 of the piston 104, that is smaller than that of the front face 110. The pressure bearing surface areas on the rear and the front faces 112 and 110 are discussed further below.

The rear portion 121 has been described as being smaller in diameter than the front portion 120. It is alternatively possible for a rod to be provided wherein the rear portion is the same diameter as the front portion (ie. whereby the entire rod is of a constant diameter, and is suited to occupy a selected portion of the surface area on the rear face 112 of the piston 104). However, it is not necessary for the entire rod to be of a constant diameter.

The actuation system regulator 101 is mounted in fluid communication with the air conduit 98 to receive air from the primary regulator (not shown). More specifically, the paintball marker 94 may include a manifold 122 that has an internal air conduit 123 therein that is in fluid communication with the air conduit 98.

The manifold 122 has a first port 123*a* for connection to the actuation system regulator 101. The manifold 122 may optionally also include a second port 123*b*, which may be used as desired, or which may be plugged when not in use. It is alternatively possible for the primary regulator (not shown) to be connected directly into the manifold 122 using the optional port 123*b*, instead of being connected to the air conduit inlet 98*a*. In that case, it will be appreciated that the inlet 98*a* would require plugging.

The control valve 100 controls the movement of the piston 104 by controlling the flow of air from the regulator 101 to the first and second ports 106 and 108 on the pneumatic cylinder 99. The control valve 100 has a single inlet port 124, a first outlet port 126 and a second outlet port 128. The inlet port 124 is connected to the regulator 101 by means of a first conduit 130. The first outlet port 126 is connected to the first port 106 on the pneumatic cylinder 99 by means of a second conduit 132. The second outlet port 128 is connected to the second port 108 on the pneumatic cylinder 99 by means of a third conduit 134.

Figure 5A:
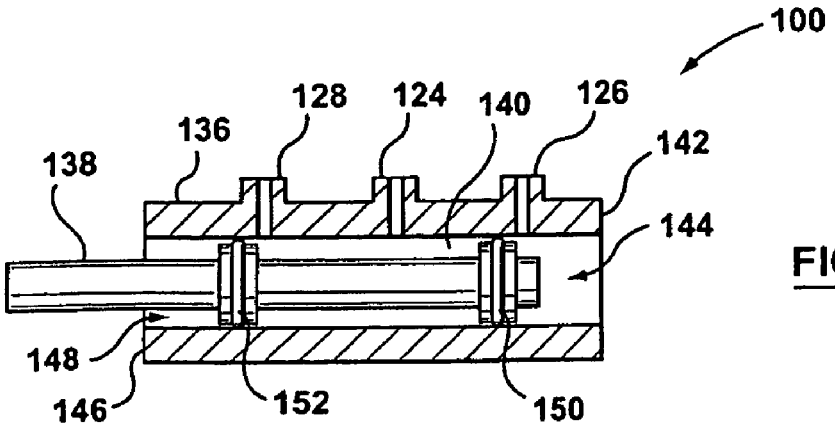
FIGS. 5*a* and 5*b* are magnified sectional side views of a control valve for use with the paintball marker shown in FIG. 4*a;*
Figure 5B:
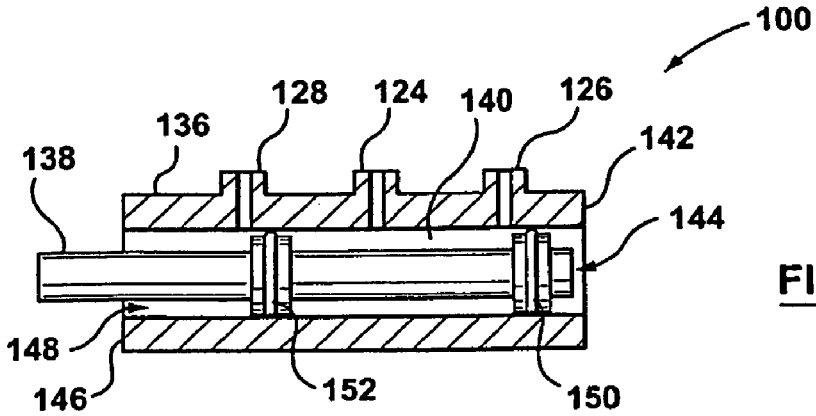

Reference is made to FIGS. 5*a* and 5*b* which show the control valve 100 in more detail, and which illustrate its operation. The control valve 100 includes a housing 136 and a valving element 138. The housing 136 defines an internal passage 140 therethrough. The inlet port 124 and the first and second outlet ports 126 and 128 each communicate with the internal passage 140 and are arranged in a linear orientation on the housing 136, with the inlet port 124 positioned between the two outlet ports 126 and 128. The housing 136 has a first end 142 in which is positioned a first vent 144. The housing 136 has a second end 146 in which is positioned a second vent 148. The valving element 138 includes a first seal 150 and a second seal 152. In a first control valve position, which is shown in FIG. 5*a*, the first seal 150 is positioned between the inlet port 124 and the first outlet port 126, so that fluid communication between these two ports is prevented. Furthermore, the first outlet port 126 is in fluid communication with the first vent 144, which causes the portion of the pneumatic cylinder housing 102 in front of the piston 104 to be at substantially atmospheric pressure (see FIG. 4*a*). The first and second seals 150 and 152 cooperate to define a chamber around the inlet port 124 and the second outlet port 128. In doing so, the control valve 100 transmits air from the regulator 101 to the portion of the pneumatic cylinder housing 102 behind the piston 104, which drives the piston 104 to its forwardmost position, as shown in FIG. 4*a*.

Reference is made to FIG. 5*b*, which shows the control valve 100 in a second control valve position. In this position, the second seal 152 is positioned between the inlet port 124 and the second outlet port 128, preventing them from communicating with each other. Furthermore, the second outlet port 128 is in fluid communication with the second vent 148, and consequently the portion of the pneumatic cylinder housing 102 behind the piston 104 is at substantially atmospheric pressure (see FIG. 4*b*). Furthermore, the first and second seals 150 and 152 cooperate to define a chamber around the inlet port 124 and the first outlet port 126, so that air is transmitted from the actuation system regulator 101 to the portion of the pneumatic cylinder housing in front of the piston 104 (see FIG. 4*b*).

The movement of the valving element 138 between the first and second control valve positions may be initiated by moving a trigger 154 which may be connected to the valving element 138 by any suitable means (not shown). The connection means may be mechanical, pneumatic, hydraulic, electrical, electronic, or any combination thereof.

It will be noted that in the embodiment shown in FIGS. 4*a* and 4*b*, the same air pressure is used to actuate the piston 104 in both directions, i.e. towards its forwardmost position and towards its rearwardmost position. However, because the pressure bearing surface area of the rear face 112 of the piston 104 is smaller than that of the front face 110, the force with which the piston 104 is driven towards its forwardmost position is smaller than the force with which the piston 104 is driven towards its rearwardmost position. The pressure bearing surface area on the rear face 112 may be selected so that the force with which the bolt 97 is moved towards the closed position is low enough to inhibit the rupturing of a paintball 12 in the event of a paintball mis-feed.

Figure 6:
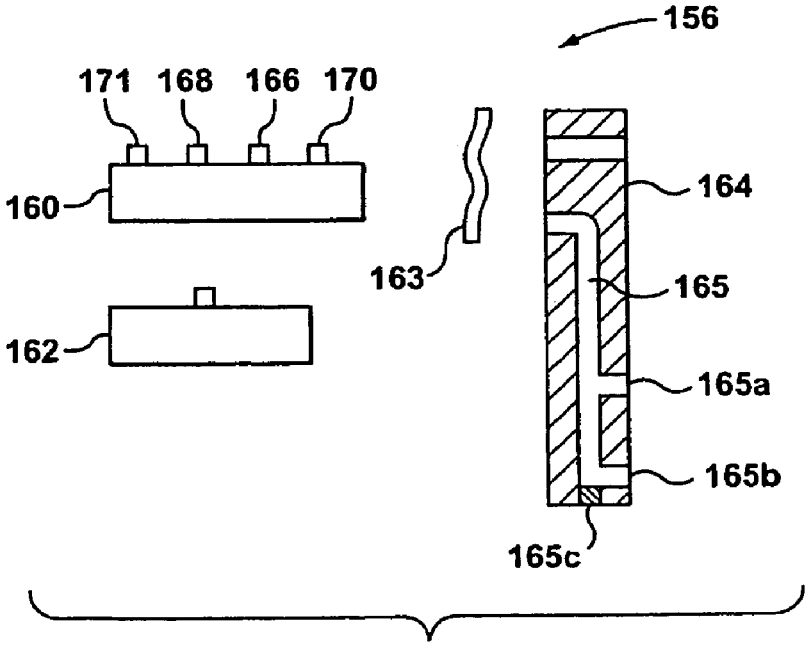
FIG. 6 is a kit of parts in accordance with another embodiment of the present invention for retrofit to a paintball marker of the prior art.
Figure 7:
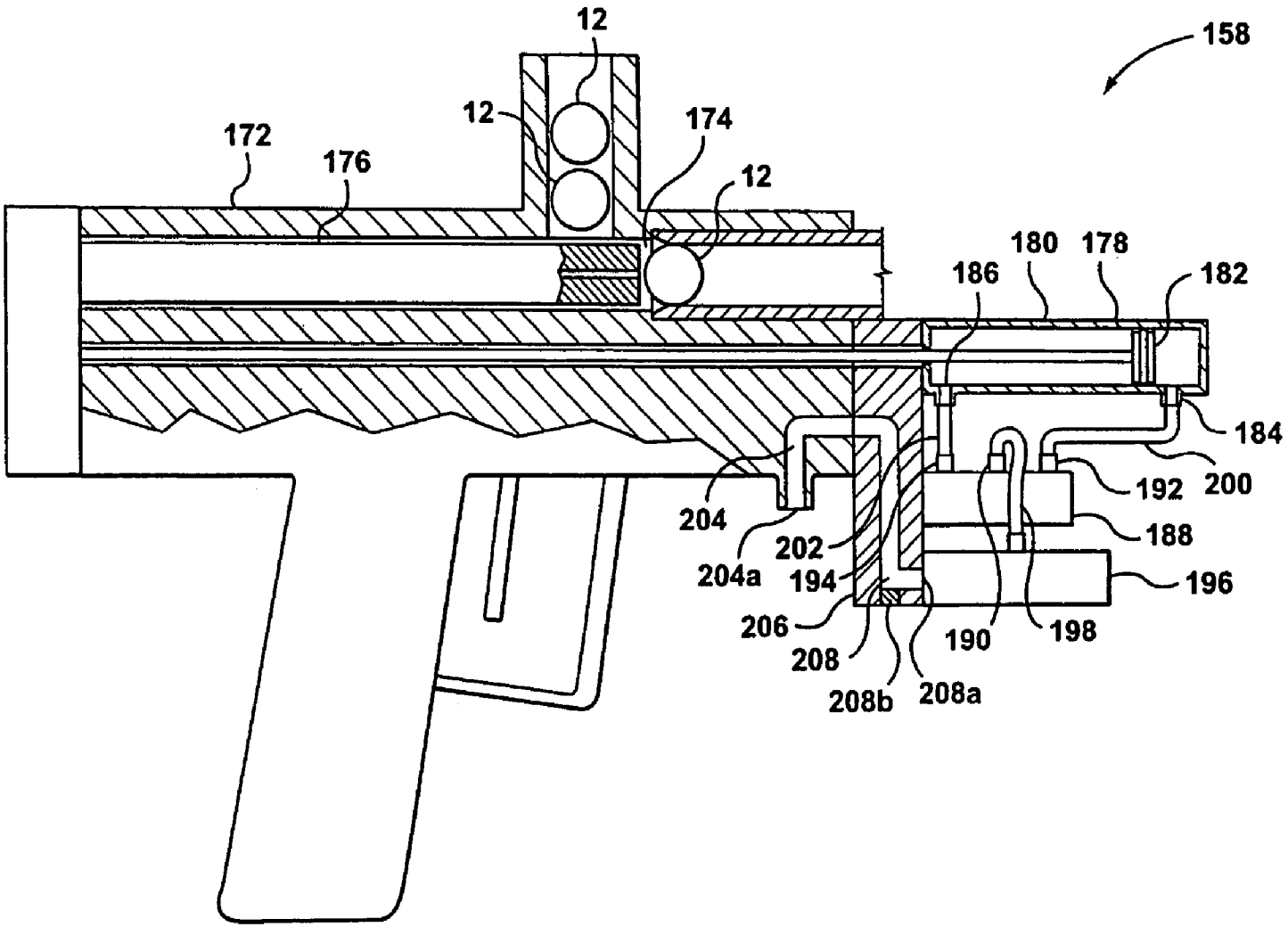
FIG. 7 (Prior Art)
FIG. 7 is a paintball marker of the prior art.

Reference is made to FIGS. 6 and 7. A kit of parts 156 is shown in FIG. 6, in accordance with another embodiment of the present invention. The kit of parts 156 can be retrofitted to a paintball marker 158 of the prior art, as shown in FIG. 7, to provide the paintball marker 158 with a reduced tendency for rupturing paintballs during bolt closure. The kit of parts 156 includes a control valve 160, a regulator 162, a conduit 163 and a manifold 164.

The control valve 160 may be similar to the control valve 38 in the embodiment shown in FIG. 1*a*. The control valve 160 includes a first inlet port 166, a second inlet port 168, a first outlet port 170 and a second outlet port 171.

The regulator 162 may be similar to the regulator 42 in the embodiment shown in FIG. 1*a*. The regulator 162 may be configured to produce an outlet pressure of approximately 5 psi to approximately 50 psi, is preferably configured to produce an outlet pressure of approximately 10 psi to approximately 50 psi, and is more preferably configured to produce an outlet pressure of approximately 10 psi to approximately 20 psi.

The manifold 164 may be similar to the manifold 54 in the embodiment shown in FIG. 1*a*. The manifold 164 has an air conduit 165 therein, and has a first port 165*a* and a second port 165*b* in communication with the air conduit 165. The manifold 164 may also have a third port 165*c* in communication with the air conduit 165. The port 165*c* is shown as being plugged in FIG. 6, since the kit of parts 156 can operate without the need for the port 165*c*.

Referring to FIG. 7, the paintball marker 158 of the prior art includes a body 172 that defines a breech 174 for receiving a paintball 12 to be fired. A bolt 176 is slideable within the breech 174, between a closed position, as shown in FIG. 7, and an open position (not shown).

An actuator, eg. a pneumatic cylinder 178 is operatively connected the bolt 176 for moving the bolt 176 between the open and closed positions. The pneumatic cylinder 178 includes a housing 180 and a piston 182. The housing 180 has a first port 184 and a second port 186.

A control valve 188 is used to control the movement of the piston 182 in the pneumatic cylinder 178. The control valve 188 may be similar to the control valve 100 in the embodiment shown in FIG. 4*a*, and includes an inlet port 190, a first outlet port 192 and a second outlet port 194. The inlet port 190 is connected to the outlet of a pressure regulator 196 by means of a first conduit 198. The first outlet port 192 is connected to the first port 184 on the pneumatic cylinder 178 by means of a second conduit 200. The second outlet port 194 is connected to the second port 186 on the pneumatic cylinder 178 by means of a third conduit 202.

The control valve 188 is used to direct air from the regulator 196 to either of the two ports 184 and 186 on the pneumatic cylinder 178. Thus, the same air pressure is used to drive the piston 182 in both directions, i.e., towards its forwardmost position, and towards its rearwardmost position. The pressure bearing surface area of the piston 182 is substantially the same on both its front face and its rear face, and as a result, the force exerted on the piston 182 by the air is substantially the same in both directions.

The paintball marker 158 may be connectable to a pressurized air tank 400 (FIG. 1*i*) and a primary regulator (not shown) through an air conduit 204 which has an inlet 204*a*, and in turn, through a manifold 206, which has an air conduit 208 that is in communication with the air conduit 204. The manifold 206 has a first port 208*a*, which communicates pressurized air from the primary regulator (not shown) to the actuation system regulator 196. The manifold 206 may have a second port 208*b*, which is typically plugged. The manifold 206 may be removable from the body 172 of the marker 158.

In order to prepare the paintball marker 158 for retrofit with the kit of parts 156, the control valve 188 is removed from the paintball marker 158. The manifold 196 may be removed from the paintball marker 158. The conduits 198, 200, and 202 are not required to be removed from the regulator 196 and the pneumatic cylinder 178, respectively.

The manifold 164 may be mounted to the body 172 so that the manifold air conduit 165 is in fluid communication with the air conduit 204. The control valve 160 (FIG. 6) may be attached to the manifold 164, or alternatively to the body 172. The regulators 196 and 162 and the pneumatic cylinder 178 may be mounted to the manifold 164. Alternatively, some or all of these components may be mounted to the body 172. However, the regulators 196 and 162 are to be mounted in any case so that they are each in fluid communication with the air conduit 165, eg. through the ports 165*a* and 165*b*.

Figure 8:
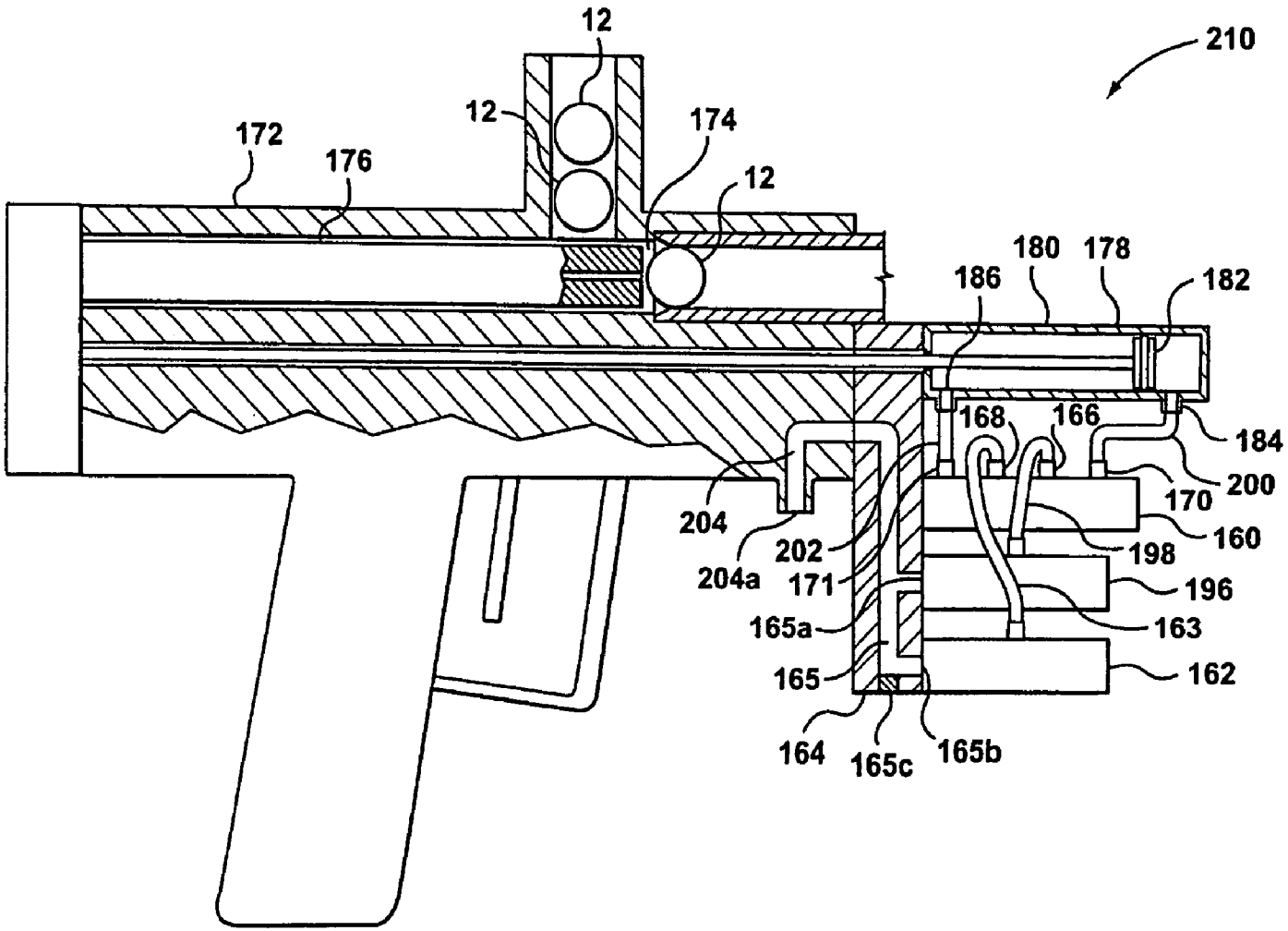
FIG. 8 is a paintball marker derived from retrofitting the kit of parts of FIG. 6 to the paintball marker of FIG. 7.

Reference is made to FIG. 8, which shows a paintball marker 210, which is the paintball marker 158 of FIG. 7 retrofitted with the kit of parts 156 of FIG. 6. The conduit 198 leading from the regulator 196 may be connected to the first inlet port 166. The conduit 200 leading from the first port 184 on the pneumatic cylinder 178 may be connected to the first outlet port 170. The conduit 202 leading from the second port 186 on the pneumatic cylinder 178 may be connected to the second outlet port 171. The outlet of the regulator 162 may be connected to the second inlet port 168 on the control valve 160 by means of the conduit 163. Once the above steps are completed, the paintball marker 158 of the prior art (FIG. 7) has been converted into the paintball marker 210. The control valve 160 controls the actuation of the pneumatic cylinder 178, instead of the control valve 188 (FIG. 7). Similarly to the control valve 38 in the embodiment shown in FIG. 1*a*, the control valve 160 directs air from the regulator 162 to drive the piston 182 towards its forwardmost position, and directs air from the regulator 196 to drive the piston 182 towards its rearwardmost position. Because the regulator 162 provides air at a lower pressure than the regulator 196, the force with which the bolt 176 closes is less than the force with which the bolt 176 opens. The pressure of the air provided by the regulator 162 may be selected to inhibit rupturing of paintballs 12 in the event that the bolt 176 jams against a paintball 12 during bolt closure.

Optionally, the kit of parts 156 of FIG. 6 may be provided with enough conduit to replace the conduits 198, 200 and 202. The conduits 198, 200 and 202 may require replacement if they are damaged during disconnection from the control valve 188 and from the regulator 196. The conduit provided with the kit of parts 156 may be cut into separate lengths configured to replace the conduits 198, 200 and 202, as well as a length for the conduit 163. Alternatively, the conduit provided with the kit of parts 156 may be a single length of conduit that the user can cut as desired to provide the conduit 163 and to replace whichever of the conduits 198, 200 and 202 require replacement, if any. As another option, the kit of parts 156 of FIG. 6 may lack any conduits, with the expectation that any conduits that are required may be supplied by the user who acquires the kit of parts 156 for retrofit it to the marker 158.

In the case where the existing manifold 206 (FIG. 7) on the paintball marker 158 of the prior art, includes the second port 208*b* (FIG. 7), the manifold 164 (FIG. 6) is not required to be included in the kit of parts 156 (FIG. 6). This is because the second regulator 162 (FIG. 6) may be connected into the port 208*b* (FIG. 6) on the existing manifold 206 (FIG. 6). In this case, it is not important whether the existing manifold 206 (FIG. 6) is a separate piece that is removable from the paintball marker 158 (FIG. 7) or is integral with the body 172 (FIG. 7) of the marker 158 (FIG. 6).

Furthermore, the second regulator 162 (FIG. 8) has been described as being connected to a second port 165*b* (FIG. 8) or 208*b* (FIG. 7) that is provided on the manifold 164 (FIG. 8) or 206 (FIG. 7), so that the second regulator 162 (FIG. 8) is in fluid communication with the pressurized air from the primary regulator (not shown). It is not important how the second regulator 162 (FIG. 8) is made to be in communication with the pressurized air. It may be by any means. For example, in the case (not shown) where the existing manifold does not include a second port and is not removable, the user may be instructed to machine a second port into the existing manifold for receiving the second regulator 162 (FIG. 8). Thus, in this instance, the new manifold 164 (FIG. 6) may be omitted from the kit of parts 156 (FIG. 6).

Referring to FIG. 6, the regulator 162 has been described as being included as part of the kit of parts 156. It is alternatively possible for the kit of parts 156 to not have a regulator for providing air at a second pressure. Instead, the user may be instructed to provide an equivalent to the regulator 162, and to connect it to the marker 158 to provide air at the second pressure, eg. approximately 5 psi to approximately 50 psi.

Figure 9:
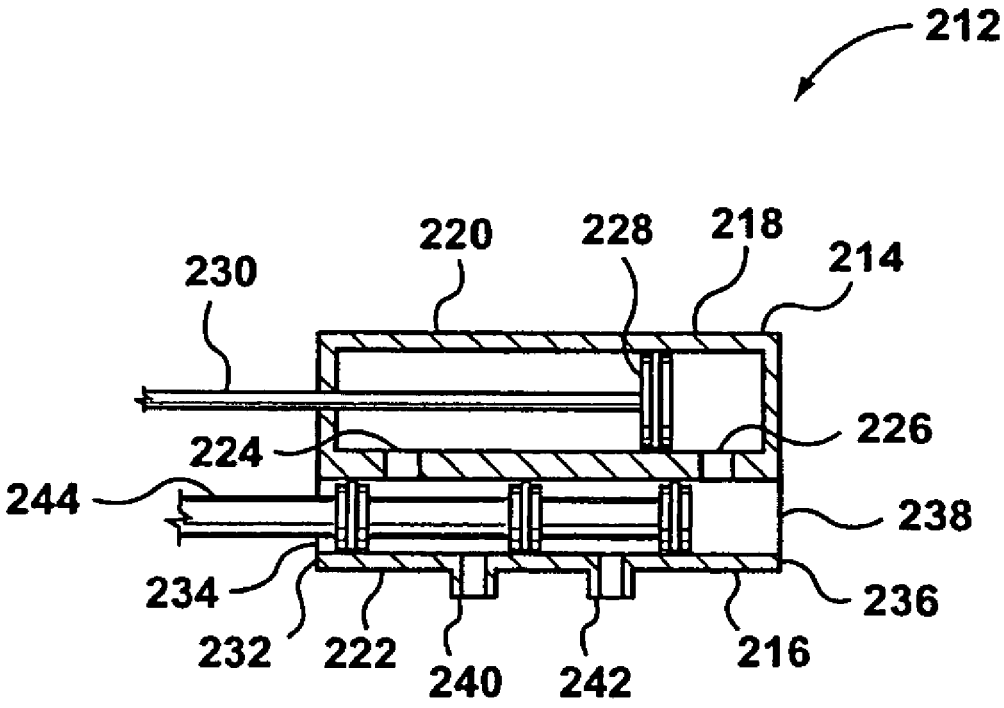
FIG. 9 is a magnified sectional side view of a combined cylinder/control valve unit that may be incorporated into the paintball markers shown in FIGS. 1*a* and 8.

Reference is made to FIG. 9, which shows a combined unit 212, having therein a pneumatic cylinder 214 and a control valve 216. The combined cylinder/valve unit 212 may be used to replace the pneumatic cylinder 37 and the control valve 38 in the embodiment of the invention shown in FIG. 1*a*. Furthermore, it is possible that the combined cylinder/valve unit 212 may be included as part of the kit of parts 156 shown in FIG. 6, instead of the control valve 160. Referring to FIG. 7, the pneumatic cylinder 178 and the control valve 188 would, in this case, be removed from the paintball marker 158 and replaced by the combined unit 212. The connection means between the trigger and the control valve 216 may, in this case, require some reconfiguring due to the new positioning of the control valve 216, relative to the position of the original control valve 188.

The combined unit 212 has a body 218. The body 218 has a first portion 220 that serves as a cylinder housing, and a second portion 222 that serves as a control valve housing. A first port 224 and a second port 226 permit fluid communication between the cylinder housing 220 and the control valve housing 222. The first and second ports 224 and 226 serve as first and second outlet ports from the control valve 216, and also serve as first and second inlet ports for the cylinder 214.

A piston 228 is positioned in the cylinder housing 220. The piston 228 is moveable in the cylinder housing 220 between the first and second ports 224 and 226, based on the entry and discharge of pressurized air through the first and second ports 224 and 226. A rod 230 extends from the piston and may be connected directly or indirectly to a back plate on a paintball marker of the present invention.

The control valve housing 222 has a first end 232 in which there is a first vent 234, and a second end 236 in which there is a second vent 238. The first and second vents 234 and 238 permit pressurized air in the cylinder 214 to discharge as required during movement of the piston 228.

The control valve housing 222 has a first inlet port 240 and a second inlet port 242. The inlet ports 240 and 242 are positioned generally centrally, and may be circumferentially opposed to the first and second outlet ports 224 and 226, to facilitate connection to other components, such as conduits for pressurized air.

A valving element 244, which may be similar to the valving element 74, is positioned in the control valve housing 222. The valving element 244 is moveable within the control valve housing 222 to permit fluid communication between either the first inlet and outlet ports 240 and 224, or between the second inlet and outlet ports 242 and 226. If the first inlet and outlet ports 240 and 224 are permitted to communicate, eg. in the control valve position shown in FIG. 9, the second outlet port 226 is in fluid communication with the second vent 238. If the second inlet and outlet ports 242 and 226 are permitted to communicate (not shown), the first outlet port 224 is in fluid communication with the first vent 234. In this way, when the portion of the cylinder housing 220 behind the piston 228 is being charged with pressurized air, the portion of the cylinder housing 220 in front of the piston 228 is venting pressurized air, and vice versa.

It has been described that the combined cylinder/control valve unit 212 could be provided with the paintball marker 10 (FIG. 1*a*) and the kit of parts 156 (FIG. 6). It is alternatively possible to have a similar combined cylinder/control valve unit (not shown) that would be an analogous combination of the pneumatic cylinder 99 and the control valve 100 (FIG. 4*a*). In that instance, the cylinder would include first and second ports which would communicate with the control valve, however, the control valve would include a single inlet port, since the unit would not require inlet air at two different pressures to operate.

Particular examples of flow control valve have been described above. It will be noted that any suitable type of flow control valve may be used instead of those described above.

In the embodiments described above the inlet control device 15 has comprised a bolt. It is alternatively possible for the inlet control device 15 to include any other suitable device instead of, or in addition to, a bolt. For example, referring to FIGS. 18*a*, 18*b* and 18*c*, a marker in accordance with the present invention may include a sliding door 420 that is movable between an open position (FIG. 18*a*) and a closed position (FIG. 18*b*). In the open position (FIG. 18*a*), the sliding door 420 permits entry of a paintball 12 through the paintball inlet 22 into a chamber 424 in the body 14 of the marker. In the closed position (FIG. 18*b*), the door 420 captures the paintball 12 in the chamber 424. The chamber 424 may comprise the inlet to a barrel 426, and is configured so that when the door 420 is closed, the paintball 12 is chambered in the barrel 426. Aft of the paintball 12 is an outlet 428 for releasing firing gas to fire the paintball 12 through the barrel 42 and out of the marker 10.

Figure 18C:
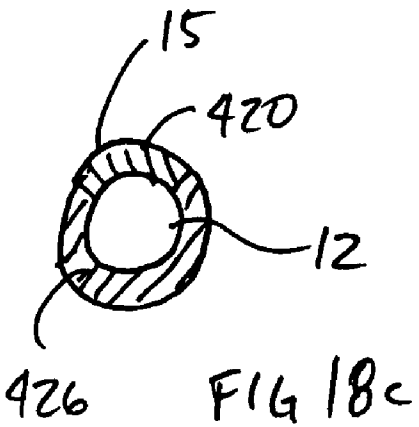
FIG. 18*c* is a sectional view along section lines 18*c*—18*c* in FIG. 18*b;*

As shown in FIG. 18*c*, the sliding door 420 may have a curved cross-sectional shape to more closely mate with the paintball 12, thereby reducing any leakage of firing gas around the paintball 12 during firing (See FIG. 18*c*).

The door 420 may be operated pneumatically by the actuation system 18. The actuation system 18 may include, for example, the pneumatic cylinder 37, or may alternatively include any other suitable actuator.

Accordingly, the sliding door 420 could be operated advantageously with gas from the second regulator 42 (see FIG. 1*a*), ie. at a pressure that is selected to be sufficiently low to inhibit rupturing of a paintball 12 in the event that the sliding door 420 confines a paintball 12. The reduced pressure gas may also be used to open the sliding door 420. Furthermore, the sliding door 420 may be controlled by means of a flow control valve such as the valve 380.

Figure 18A:
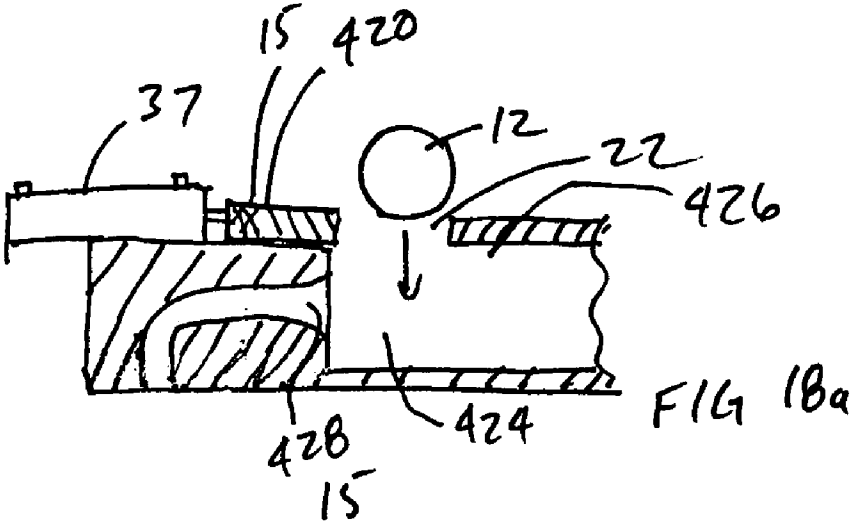
FIGS. 18*a* and 18*b* are sectional side views of an alternative inlet control device to that shown in FIG. 1, for use with a marker in accordance with the present invention.
Figure 18B:
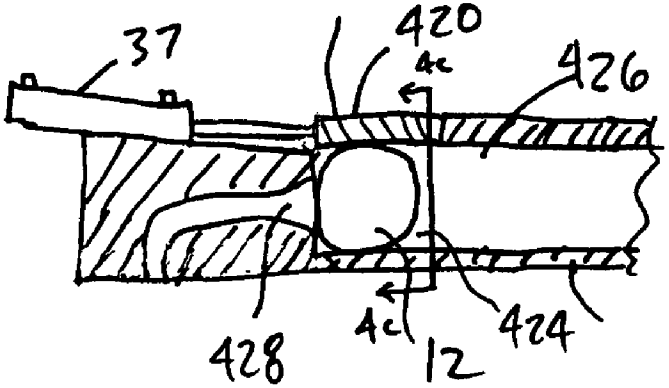

As a further alternative (not shown) to the inlet control device 15 shown in FIGS. 18*a* and 18*b*, the marker may include both the sliding door 420 and a moveable bolt such as the bolt 16 shown in FIG. 1*a*. The bolt may be separately moveable relative to the sliding door 420 so that a loading sequence may comprise: opening the sliding door 420 and the bolt to permit entry of a paintball 12 into a breech; closing the sliding door 420; and finally moving the bolt forward to chamber the paintball 12. In this case, the sliding door 420 may be flat, since it would not necessarily form part of the barrel and accordingly would not be involved in inhibiting air leakage past the paintball 12 during firing, in contrast to the embodiment shown in FIGS. 18*a* and 18*b*. In this alternative that is not shown, one or both of the bolt and the sliding door 420 could be operated advantageously with gas from the second regulator 42 (see FIG. 1*a*), ie. at a pressure that is selected to be sufficiently low to inhibit rupturing of a paintball 12 in the event that it confines a paintball 12 during closure. The reduced pressure gas from the second regulator 42 (FIG. 1*a*), may also be used to open the sliding door 420 and/or the bolt. Furthermore, one or both of the sliding door 420 and the bolt may be controlled by means of a flow control valve such as the valve 380. In other words, one flow control valve 380 may be used to control either or both of the sliding door 420 and the bolt; or alternatively, two flow control valves 380 may be provided, wherein one valve 380 is provided for each of the sliding door 420 and the bolt.

Reference is made to FIGS. 19*a*, 19*b*, 19*c* and 19*d*, which show another alternative inlet control device 15 for use with a marker in accordance with the present invention. The inlet control device 15 in this embodiment includes a rotary sliding door 430. The rotary sliding door 430 may be actuated by any suitable actuator, such as by a pneumatic cylinder 432 (not shown in FIG. 19*b*), which may be similar to the pneumatic cylinder 37 (FIG. 1*a*). The pneumatic cylinder 432 may be connected by pin connections to both the marker body 16 and to the rotary sliding door 430 to permit rotational movement of the rotary sliding door 430 about its pivot 434, during extension and retraction of the cylinder 432. The rotary sliding door 430 may be similar to the sliding door 420 (FIG. 18*a*) in that it may be moveable between an open position shown in FIG. 19*a* and a closed position shown in FIG. 19*b*. In the open position, the sliding door 430 permits entry of a paintball 12 into a chamber 436 in the body 16. If a moveable bolt is not provided, then the chamber 436 may function as the inlet to a barrel 438. When the sliding door 430 is in the closed position, it may also make up a portion of the inlet to the barrel 438. The rotary sliding door 430 may move along an arcuate channel 439 that includes at one end, the paintball inlet 22 to the marker.

Figure 19D:
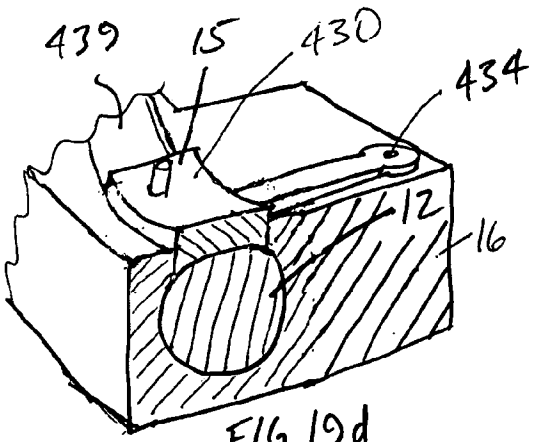
FIG. 19*d* is a sectional view along section lines 19*d*—19*d* in FIG. 19*c;*

A gas outlet 440 may be provided at the aft end of the chamber 436 for releasing firing gas to the paintball for firing the paintball through the barrel 438. Referring to FIG. 19*d*, the sliding door 430 may be contoured to match the curvature of the paintball 12 to inhibit air leakage from around the paintball 12 during firing.

Figure 19C:
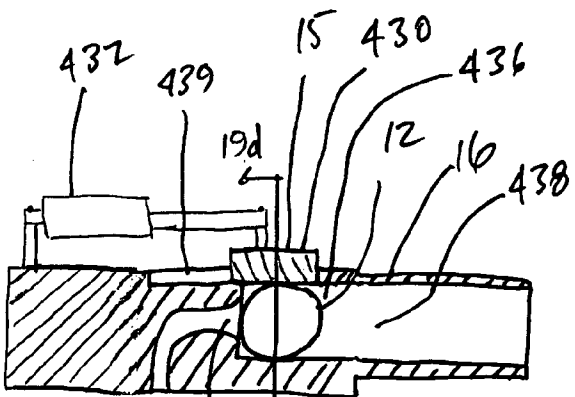
FIG. 19*c* is a sectional side view of the inlet control device shown in FIG. 19*b;*
Figure 19A:
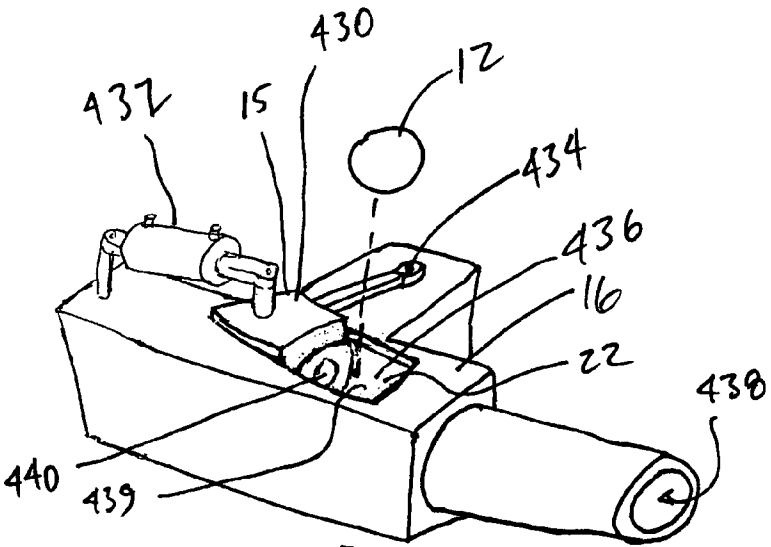
FIGS. 19*a* and 19*b* are perspective views of another alternative inlet control device to that shown in FIG. 1, for use with a marker in accordance with the present invention, wherein FIG. 19*b* has a component removed for greater clarity.
Figure 19B:
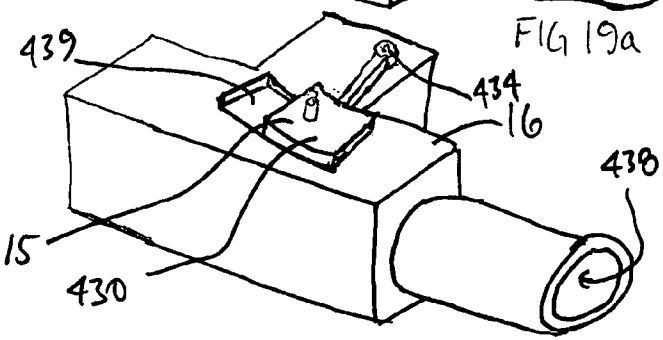

In a further alternative (not shown) to the embodiment shown in FIGS. 19*a*, 19*b* and 19*c* a moveable bolt may be provided in the chamber 436 for moving the paintball to a barrel after the paintball 12 has been fed into the chamber 436. In this alternative, the chamber functions as a breech. The sliding door 430 may be controlled using gas at a selected sufficiently low pressure eg. by gas from the second regulator 42, to inhibit paintball rupture during closure. The reduced pressure gas may also be used to open the sliding door 430. Additionally, the sliding door 430 may be controlled by a flow control valve such as the flow control valve 380. Furthermore, if a bolt is provided for use in conjunction with the sliding door 430, the bolt may also be controlled by the same flow control valve, or by a dedicated flow control valve such as the valve 380.

Figure 20A:
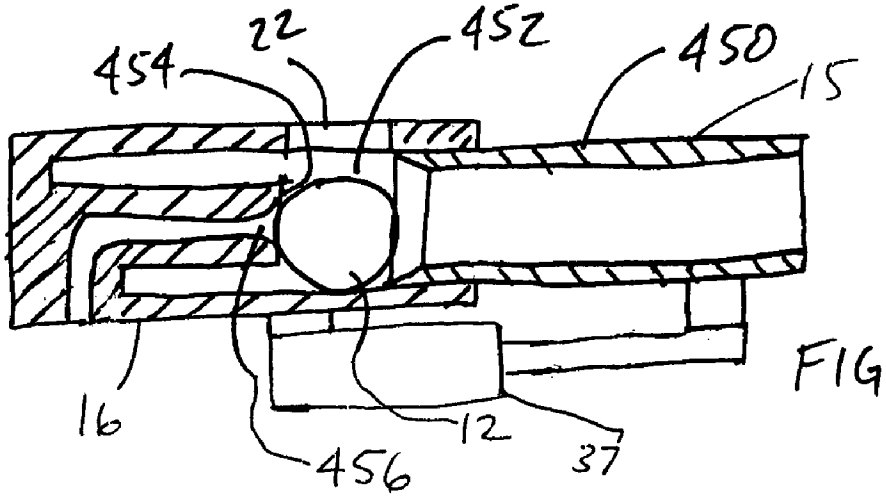
FIGS. 20*a* and 20*b* are sectional side views of yet another alternative inlet control device to that shown in FIG. 1, for use with a marker in accordance with the present invention.
Figure 20B:
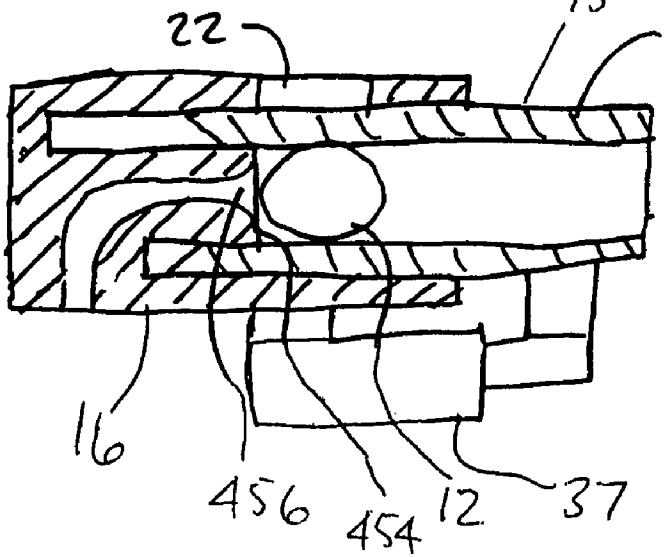

Reference is made to FIGS. 20*a* and 20*b*, which show another alternative inlet control device 15 for use with a marker in accordance with the present invention. The inlet control device 15 may include a barrel 450 that is movable in a breech 452. When the barrel 450 is in an open position (FIG. 20*a*), entry of a paintball 12 through the inlet 22 into the breech 452 is permitted. The breech 452 includes an aft wall 454 which includes a gas outlet 456 for the firing gas.

When the barrel 450 moves aftwards to a closed position, it brings the paintball 12 into its inlet, since the paintball 12 is prevented from aft movement by the aft wall 454 of the breech 452. Also, in the closed position, paintballs are prevented from entry into the breech 452. Firing gas may then be released for firing of the paintball 12 from the barrel 450. The barrel 450 may be moved by means of the actuator 37, which may be a pneumatic cylinder 37. For example, the cylinder 37 may include a piston rod 458 which may be connected by any suitable means to the barrel 450 so that when the piston in the cylinder 37 moves, the barrel 450 moves.

The movable barrel may be controlled using gas at a selected sufficiently low pressure eg. by gas from the second regulator 42 (FIG. 1*a*), to inhibit paintball rupture during closure. The reduced pressure gas may also be used to open the movable barrel 450. Additionally, the movable barrel 450 may be controlled by a flow control valve such as the flow control valve 380.

Figure 21A:
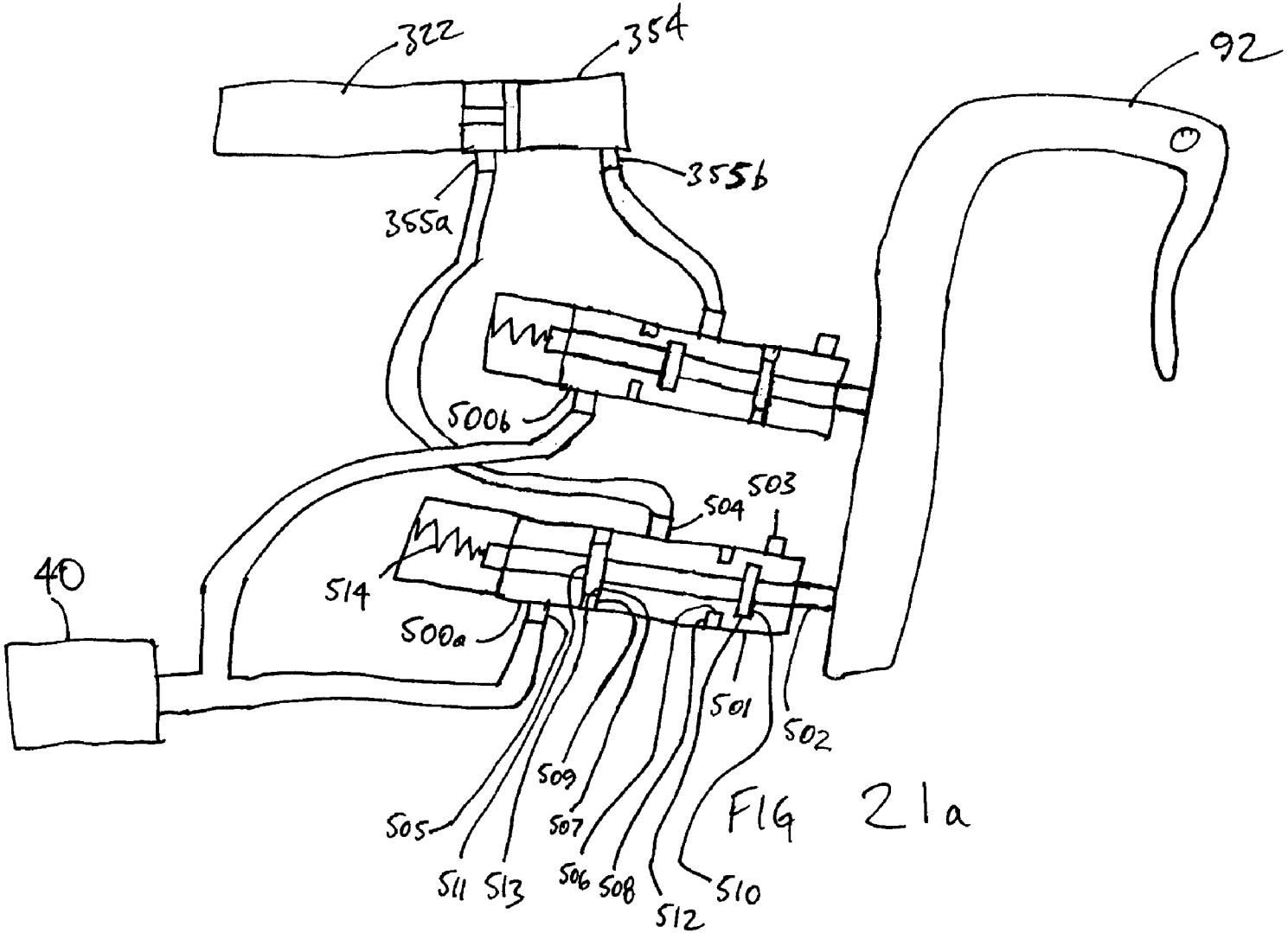
FIGS. 21*a* and 21*b* illustrate the operation of two alternative control valves to replace the control valve shown in FIGS. 11*a* and 11*b;*
Figure 21B:
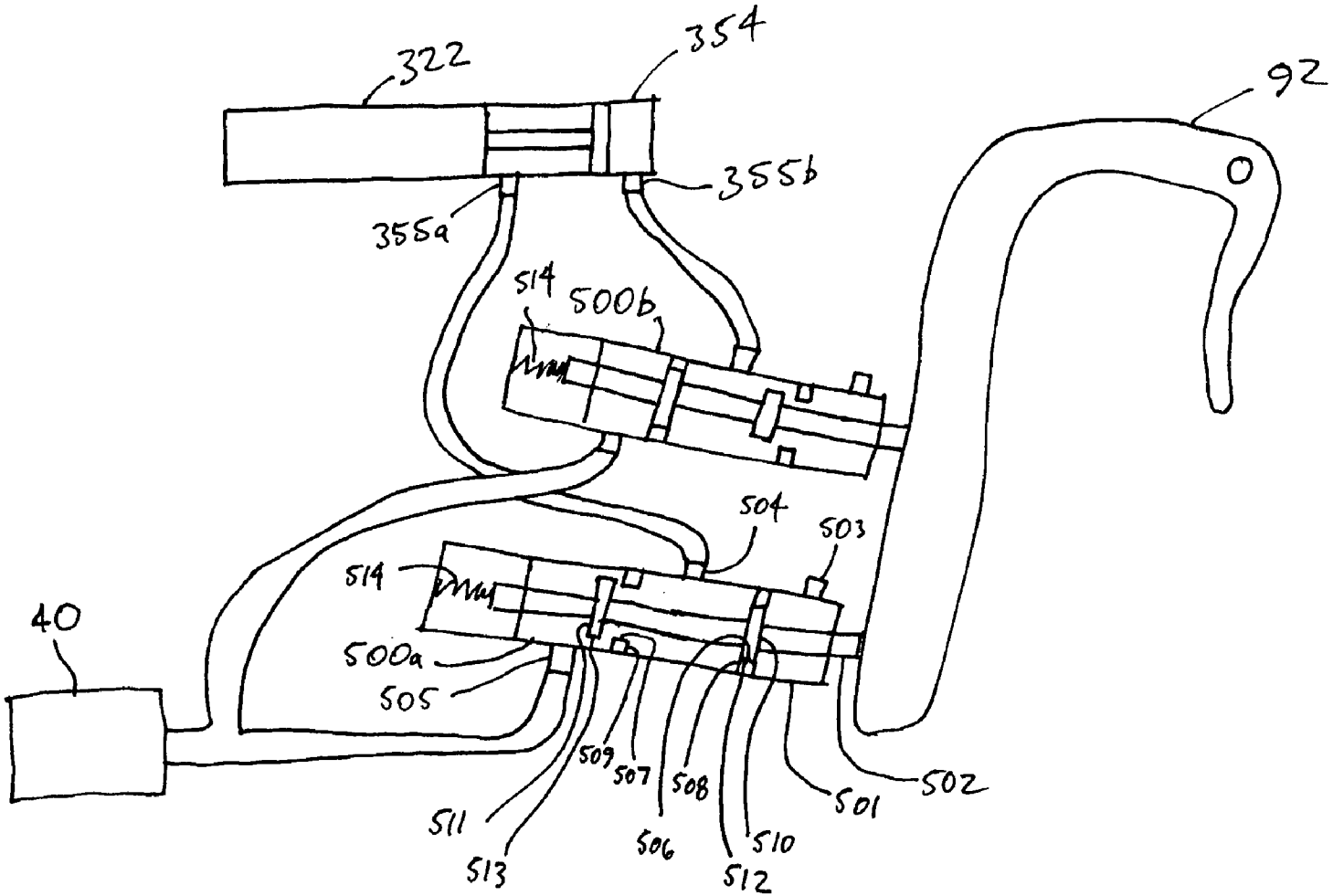

One or both of the firing valve actuation valve 352 and the inlet control device and actuation valve 380, each of which has five ports, may alternatively be functionally replaced by two actuation valves 500*a* and 500*b* each having three ports. For example, the firing valve actuation valve 352 (FIGS. 10*a*–10*c*) may be replaced by the two valves 500*a* and 500*b*, as shown in FIGS. 21*a* and 21*b*.

The first actuation valve 500*a* may be connected to the cylinder port 355*a* and may control filling and exhaustion of gas with respect to that port. The second actuation valve 500*b* may be connected to the cylinder port 355*b* for controlling filling and exhaustion of gas with respect to that port. The valves 500*a* and 500*b* may both be actuated directly from the trigger 92, as shown in FIGS. 21*a* and 21*b*. In the first position, shown in FIG. 21*a*, the trigger 92 is not actuated and the valves 500*a* and 500*b* are positioned to provide pressurized gas to the cylinder port 355*b* of the firing valve actuator 354 and to exhaust gas from the cylinder port 355*a*, so that the firing valve 322 is in its non-firing position. In the second position shown in FIG. 21*b*, the trigger is actuated and the valves 500*a* and 500*b* are positioned to provide pressurized gas to the cylinder port 355*a* of the firing valve actuator 354 and to exhaust gas from the cylinder port 355*b*, so that the firing valve 322 is in the firing position, whereby it releases firing gas to the barrel 28. A biasing mechanism 514, such as a spring may be included to bias the valves 500*a* and 500*b* to the first positions.

The valves 500*a* and 500*b* each may include a housing 501 and a spool 502. The housing 501 includes first second and third ports 503, 504 and 505. Housing sealing surfaces 506 and 507 may be positioned on housing projections 508 and 509, which are positioned between the first and second ports 503 and 504 and between the second and third ports 504 and 505 respectively. The spool 502 includes two spool projections 510 and 511, which have spool sealing surfaces 512 and 513 thereon respectively. The spool sealing surfaces 512 and 513 and the housing sealing surfaces 506 and 507 may be configured similarly to any of the configurations shown for sealing surfaces 372–375 and 367–370 in FIGS. 15*a*–15*e*.

The valve 500*a* may be configured so that the first port is an exhaust port, the second port 504 is connected to the cylinder port 355*a*, and the third port is connected to the first regulator 40.

Instead of both valves 500*a* and 500*b* being directly connected to the trigger 92, they may alternatively be mechanically or pneumatically connected to each other so that the trigger 92 engages one of the valves 500*a* and that valve engages the other of the valves 500*a* and 500*b*.

Figure 22A:
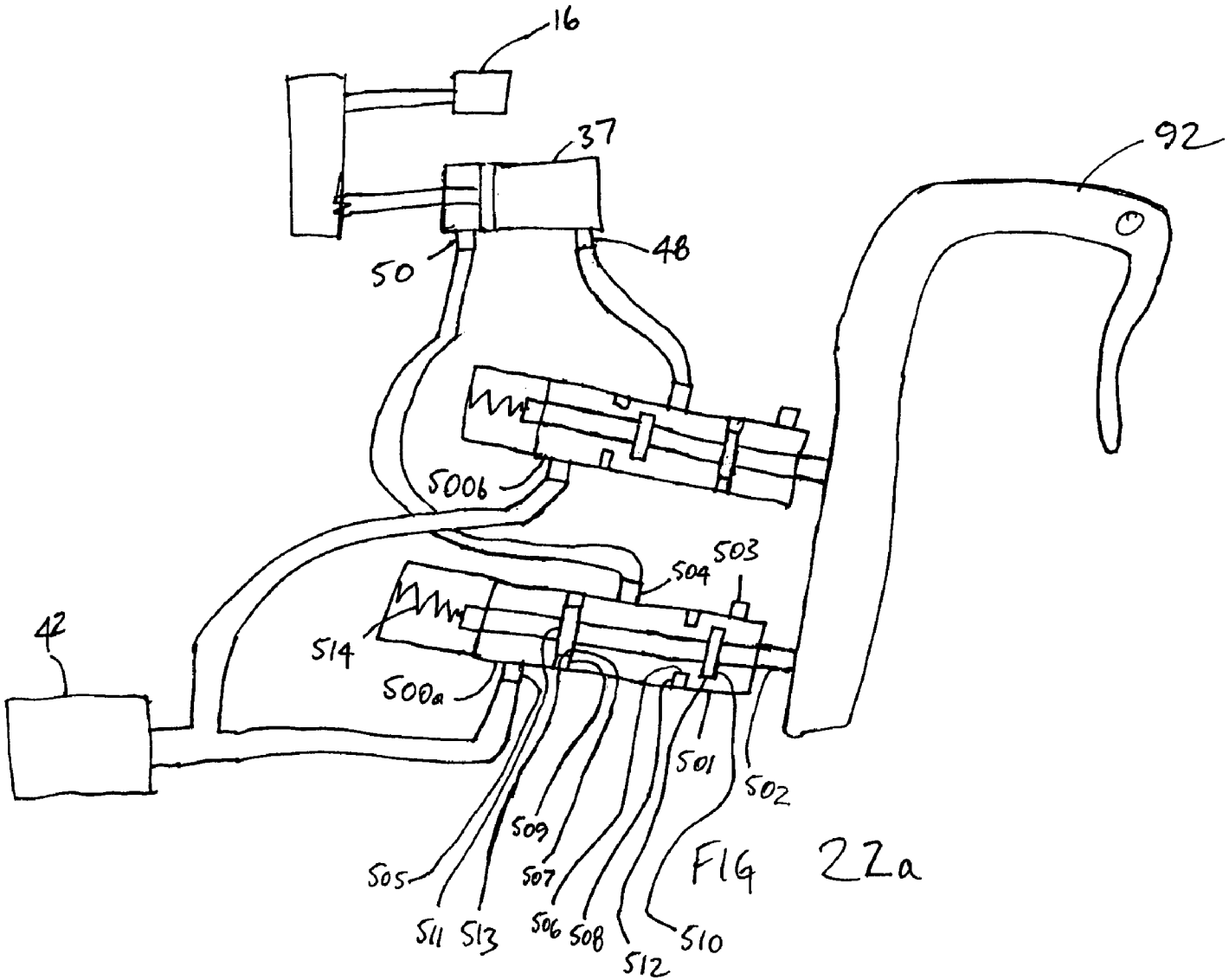
FIGS. 22*a* and 22*b* illustrate the operation of the two control valves shown in FIGS. 21*a* and 21*b* controlling a bolt, whereby both control valves are connected to a single pressure regulator.
Figure 22B:
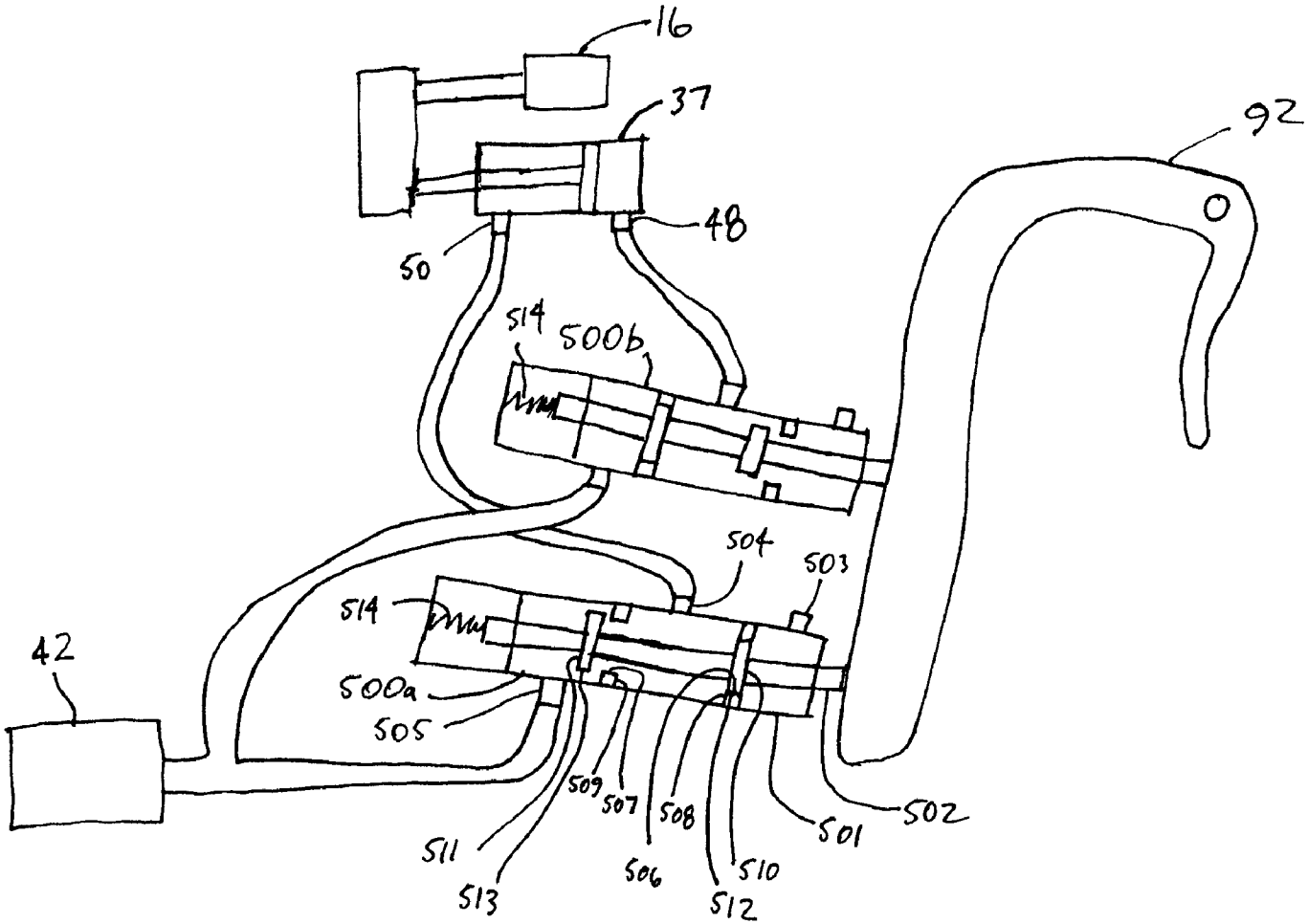

Referring to FIGS. 22*a* and 22*b*, the inlet control device actuation valve 380 (FIGS. 10*a*–10*c*) may be replaced by the two valves 500*a* and 500*b*. The valves 500*a* and 500*b* may be moveable between a bolt-open position shown in FIG. 22*a*, wherein pressurized gas from the second regulator 42 actuates the cylinder 37 and a bolt-closed position wherein pressurized gas from the second regulator 42 actuates the cylinder 37 to move the bolt 16 to a closed position.

Figure 23:
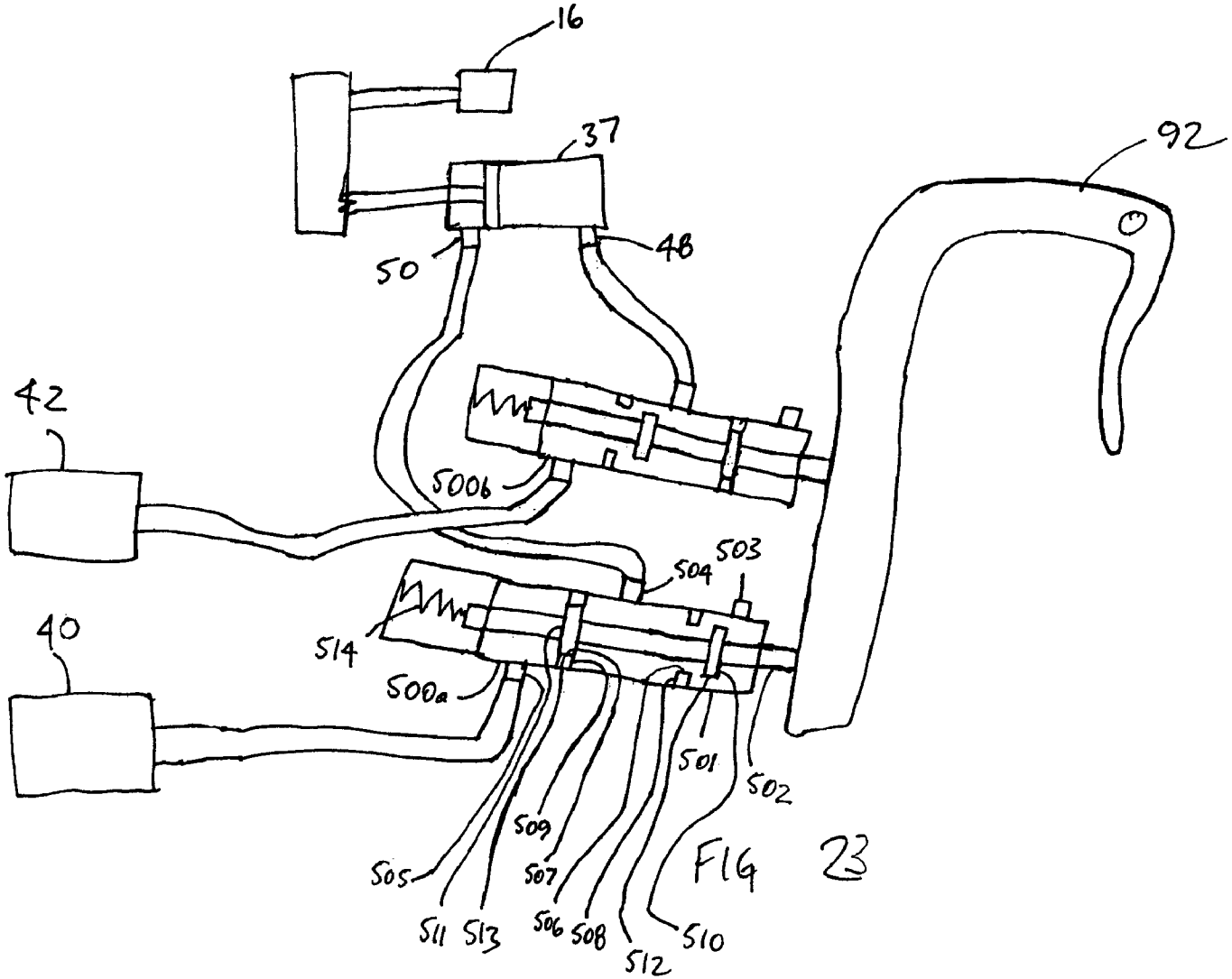
FIG. 23 shows the two control valves shown in FIGS. 22*a* and 22*b* connected to separate pressure regulators.

Referring to FIG. 23, it is alternatively possible for the first regulator 40 to be connected to the valve 500*b* for actuation of the bolt 16 to the bolt-open position, while the second regulator 42 is connected to the valve 500*a* for actuation of the cylinder 37 to the bolt-closed position.

In the embodiments wherein the markers have two regulators, one of which provides a higher pressure for opening the bolt, and one of which provides a lower pressure for closing the bolt. It is alternatively possible for the markers 10 and 210 to have a single regulator (not shown) that has two outputs, one output at a higher pressure and one output at a lower pressure, to replace the two separate regulators included in the markers 10 and 210.

In each of the embodiments described above, the outputs of the control valves have been shown to be connected to the ports on the pneumatic cylinder in a certain way. It is alternatively possible for the connections between the ports on the control valve and the ports on the pneumatic cylinder to be reversed, so that the control valve actuator would move forward to effect forward movement of the piston, and the control valve actuator would move rearward to effect rearward movement of the piston. Such a configuration may be used, depending on the mechanism connecting the trigger to the control valve.

It has been described as being advantageous to provide a paintball marker wherein a flow control valve is incorporated without a solenoid actuator, and with a mechanical or pneumatic connection to the trigger. One or more such flow control valves may be used to control one or both of the firing system and the inlet control device. By eliminating the solenoid, the reliability of operation of at least one of the firing system and the loading and chambering of a paintball is improved, since a solenoid or a sensor for contact by the trigger for actuating a solenoid, can be inadvertently rendered inoperative for example by a dead battery, or by damage during play from temperature conditions or from moisture. It will be appreciated that the marker of the present invention can include the one or more non-solenoid actuated flow control valves while still containing electronic components for control of other valves or other functions, such as an information display or a loader flow assistor.

Reference has been made in this description to an air tank and to using air to operate the actuators in accordance with the present invention. It will be appreciated that any suitable gas may be used instead of air, to operate the actuators of the embodiments described herein.

While the above description constitutes the preferred embodiments, it will be appreciated that the present invention is susceptible to modification and change without departing from the fair meaning of the accompanying claims.

The invention claimed is:

1. A paintball marker having a trigger and a flow control valve, wherein the trigger is operatively connected to the flow control valve, the flow control valve including a housing defining an interior, the housing having a first, a second, a third, a fourth and a fifth port, wherein the ports are longitudinally spaced apart, wherein the housing further includes a first, a second, a third and a fourth housing projection extending into the interior longitudinally between the first and second ports, the second and third ports, the third and fourth ports and the fourth and fifth ports respectively, the housing projections having a first, a second, a third and a fourth housing sealing surface thereon respectively, the flow control valve further including an elongate valve spool that is slidably mounted in the housing, the valve spool having a first, a second, a third and a fourth generally ring-shaped spool projection, wherein the spool projections are longitudinally spaced apart, the spool projections having a first, a second, a third and a fourth spool sealing surface thereon respectively for sealing engagement with the housing sealing surfaces, wherein the valve spool is moveable between a first position wherein the second and fourth spool sealing surfaces seal against the second and fourth housing sealing surfaces respectively to permit fluid communication between the third port and the fourth port and between the first port and the second port, and a second position wherein the first and third spool sealing surfaces seal against the first and third housing sealing surfaces respectively to permit fluid communication between the second port and the third port and between the fourth port and the fifth port, wherein the valve spool is engageable by the trigger by at least one of a mechanical and a pneumatic connection for movement to at least one of the first and second positions.

2. A paintball marker as claimed in claim 1, wherein the trigger directly engages the valve spool.

3. A paintball marker as claimed in claim 2, wherein the flow control valve is operatively connected to a firing valve, wherein the firing valve is moveable between a closed position for preventing flow of firing gas therethrough and an open position for permitting flow of firing gas to a chambered paintball.

4. A paintball marker as claimed in claim 1, wherein the housing sealing surfaces are generally cylindrical and the spool projections fit inside the cylindrical housing sealing surfaces.

5. A paintball marker as claimed in claim 1, wherein the housing sealing surfaces each include an edge and wherein the spool sealing surfaces are configured to sealingly mate with the edges.

6. A paintball marker as claimed in claim 5, wherein the spool sealing surfaces are generally frusto-conical.

7. A paintball marker as claimed in claim 5, wherein the spool sealing surfaces are generally toroidal.

8. A paintball marker as claimed in claim 1, wherein the housing sealing surfaces are generally frusto-conical.

9. A paintball marker as claimed in claim 8, wherein the spool sealing surfaces are generally frusto-conical.

10. A paintball marker as claimed in claim 8, wherein the spool sealing surfaces are generally toroidal.

11. A paintball marker as claimed in claim 1, wherein the paintball marker includes a barrel for holding a paintball, wherein the flow control valve is operatively connected to the firing valve for movement of the firing valve to an open position to release firing gas to the barrel for firing the paintball.

12. A paintball marker as claimed in claim 1, wherein the flow control valve operatively connected to an inlet control device, wherein the inlet control device is moveable to load and chamber a paintball.

13. A paintball marker as claimed in claim 1, wherein the flow control valve operatively connected to a bolt, wherein the bolt is moveable to load and chamber a paintball.

14. A paintball marker as claimed in claim 13, further comprising a second flow control valve that is operatively connected to a firing valve, wherein the firing valve is moveable between a closed position for preventing flow of firing gas therethrough and an open position for permitting flow of firing gas to a chambered paintball.

15. A paintball marker as claimed in claim 1, wherein the flow control valve operatively connected to an inlet control device, wherein the inlet control device is moveable to load and chamber a paintball.

16. A paintball marker having a trigger and a flow control valve, wherein the trigger is operatively connected to the flow control valve, the flow control valve including a housing defining an interior, the housing having a plurality of longitudinally spaced projections extending into the interior, the projections having housing sealing surfaces thereon, and an elongate valve spool that is slidably mounted in the housing, the valve spool having a plurality of longitudinally spaced generally ring-shaped spool projections, the spool projections having spool sealing surfaces thereon for sealing engagement with the housing sealing surfaces, wherein the valve spool is moveable between a first position and a second position to control the flow of pressurized gas through the valve in one direction and the exhaustion of gas through the valve in another direction, wherein the valve spool is engageable by the trigger without an intervening solenoid, by at least one of a mechanical and a pneumatic connection for movement to at least one of the first and second positions.

17. A paintball marker as claimed in claim 16, wherein the trigger directly engages the valve spool.

18. A paintball marker as claimed in claim 17, wherein the flow control valve is operatively connected to a firing valve, wherein the firing valve is moveable between a closed position for preventing flow of firing gas therethrough and an open position for permitting flow of firing gas to a chambered paintball.

19. A paintball marker as claimed in claim 16, wherein the paintball marker includes a barrel for holding a paintball, wherein the flow control valve is operatively connected to the firing valve for movement of the firing valve to an open position to release firing gas to the barrel for firing the paintball.

20. A paintball marker as claimed in claim 16, wherein the flow control valve operatively connected to a bolt, wherein the bolt is moveable to load and chamber a paintball.

21. A paintball marker as claimed in claim 20, further comprising a second flow control valve that is operatively connected to a firing valve, wherein the firing valve is moveable between a closed position for preventing flow of firing gas therethrough and an open position for permitting flow of firing gas to a chambered paintball.

* * * * *